US008843037B2

(12) United States Patent
Ogawa et al.

(10) Patent No.: US 8,843,037 B2
(45) Date of Patent: Sep. 23, 2014

(54) IMAGE FORMING APPARATUS CORRECTING UNEVEN DENSITY CAUSED BY UNEVEN ROTATION

(75) Inventors: Yuichi Ogawa, Susono (JP); Yuuji Takayama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 313 days.

(21) Appl. No.: 13/354,778

(22) Filed: Jan. 20, 2012

(65) Prior Publication Data

US 2012/0195650 A1 Aug. 2, 2012

(30) Foreign Application Priority Data

Jan. 31, 2011 (JP) ..... 2011-01944

(51) Int. Cl.
*G03G 15/01* (2006.01)
*G03G 15/00* (2006.01)

(52) U.S. Cl.
CPC .. *G03G 15/5058* (2013.01); *G03G 2215/00059* (2013.01); *G03G 2215/00063* (2013.01); *G03G 2215/0164* (2013.01); *G03G 15/0189* (2013.01); *G03G 2215/0129* (2013.01); *G03G 15/0131* (2013.01)
USPC ..... 399/301

(58) Field of Classification Search
USPC ..... 399/301, 49
See application file for complete search history.

(56) References Cited

U.S. PATENT DOCUMENTS

2007/0248383 A1* 10/2007 Ueda et al. ..... 399/167
2009/0034034 A1* 2/2009 Ido ..... 358/525
2011/0085827 A1* 4/2011 Tominaga et al. ..... 399/301

FOREIGN PATENT DOCUMENTS

JP 2004-317538 A 11/2004
JP 2007-108246 A 4/2007

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

An image forming apparatus corrects, for uneven density caused by uneven rotation of a rotation speed of a rotation member, and diffuses so as to reduce the uneven density, for a pixel of interest whose density exceeds the upper limit of the output density out of the pixels of the corrected image data, the excess of the density more than the upper limit to a plurality of peripheral pixels while maintaining the center of gravity of the density.

15 Claims, 20 Drawing Sheets

FIG. 10A

| | | |
|---|---|---|
| | Co_a | |
| Co_b | | Co_d |
| | Co_c | |

MATRIX 1

| | | |
|---|---|---|
| Co_e | | Co_h |
| | | |
| Co_f | | Co_g |

MATRIX 2

| | | | | |
|---|---|---|---|---|
| | | Co_i | | |
| | | | | |
| Co_j | | | | Co_l |
| | | | | |
| | | Co_k | | |

MATRIX 3

| | | | | |
|---|---|---|---|---|
| Co_m | | | | Co_q |
| | | | | |
| | | | | |
| | | | | |
| Co_n | | | | Co_p |

MATRIX 4

FIG. 10B

| | | |
|---|---|---|
| | a | |
| b | o | d |
| | c | |

FIG. 10C

| | | |
|---|---|---|
| | 1/4 | |
| 1/4 | | 1/4 |
| | 1/4 | |

MATRIX 1

| | | |
|---|---|---|
| 1/4 | | 1/4 |
| | | |
| 1/4 | | 1/4 |

MATRIX 2

FIG. 10D

PIXEL DENSITY VALUE BEFORE OVERFLOW PROCESSING

| | | |
|---|---|---|
| 90% | 95% | 52% |
| 98% | 112% | 49% |
| 97% | 97% | 48% |

DIFFUSION PROCESSING USING MATRIX 1 →

PIXEL DENSITY VALUE AFTER DIFFUSION PROCESSING USING MATRIX 1

| | | |
|---|---|---|
| 90% | 97% | 52% |
| 100% | 104% | 52% |
| 97% | 99% | 48% |

DIFFUSION PROCESSING USING MATRIX 2 →

PIXEL DENSITY VALUE AFTER DIFFUSION PROCESSING USING MATRIX 2

| | | |
|---|---|---|
| 91% | 97% | 53% |
| 100% | 100% | 52% |
| 98% | 99% | 49% |

IMAGE FORMING APPARATUS CORRECTING UNEVEN DENSITY CAUSED BY UNEVEN ROTATION

BACKGROUND OF THE INVENTION

1. Field of the Invention

The present invention relates to an image forming apparatus for forming an image based on an image signal.

2. Description of the Related Art

Recently, there is a need to output a high-quality image from an image forming apparatus such as a printer or copying machine that have adopted the electrophotographic method. However, the image forming apparatus suffers uneven density called banding that occurs in the paper conveyance direction (sub-scanning direction) due to various factors in the printing mechanism. This uneven density largely affects the image quality.

The factors that cause uneven density include the mechanical factors of members concerning image formation. For example, the uneven rotation speed of a photosensitive member leads to the uneven density. The uneven rotation speed results from the uneven rotation of an electric motor that drives the photosensitive member or the decentering of the driving gear that transfers the driving force. If slow rotation and quick rotation of the photosensitive member are periodically repeated due to the uneven rotation speed of the photosensitive member, the position of an electrostatic latent image shifts at the time of exposure, or the transfer position shifts at the time of primary transfer from the photosensitive member to the intermediate transfer material. For this reason, a region where the image is densely formed on the intermediate transfer material and a region where the image is sparsely formed are repetitively generated. When this image is macroscopically observed, the region where the image is densely formed appears as high density. Conversely, the region where the image is sparsely formed appears as low density. As a result, a user recognizes it as periodical uneven density.

To solve this problem, Japanese Patent Laid-Open No. 2004-317538 proposes a technique of reducing uneven density by changing the exposure amount in accordance with image data so as to correct a position shift caused by the uneven rotation speed of a photosensitive member. Japanese Patent Laid-Open No. 2007-108246 proposes a technique of reducing uneven density by storing uneven density information, correcting the image density to cancel the uneven density, and then performing image forming processing.

However, in the above-described method of correcting the position shift or method of correcting the image density, if the maximum density of a pixel after correction exceeds 100%, the correction value is not reflected so the uneven density correction is not sufficient. This problem will be described here with reference to FIG. 20.

FIG. 20 illustrates a state in which image position correction processing is performed for dot 1, dot 2, and dot 3 located at positions i to (i+2) adjacent in the sub-scanning direction. The initial density value of the dots is 100%, as indicated by 2400. To suppress uneven density, the position of dot 2 is corrected by 0.01 dot upward in FIG. 20, and the position of dot 3 is corrected by 0.03 dot upward without correcting the position of dot 1, as indicated by 2401 to 2403.

Reference numerals 2404 to 2406 represent density distribution to each pixel when correcting the position. To correct the position of dot 2 by 0.01 dot upward in FIG. 20, correction is performed by shifting the center of gravity of dot 2 by 0.01 dot across two lines such that the density at the position i is 1%, and that at the position (i+1) is 99%, as indicated by 2405.

Similarly, to correct the position of dot 3 by 0.03 dot upward in FIG. 20, correction is performed such that the density at the position (i+1) is 3%, and that at the position (i+2) is 97%, as indicated by 2406.

The final density after the correction is the sum of these densities. As indicated by 2407, the densities at the positions i to (i+2) are 101%, 102%, and 97%. However, since a dot whose density is more than 100% cannot be formed, the excess over 100% is truncated, and the actual densities at the positions i to (i+2) are 100%, 100%, and 97%. If the density after the correction exceeds 100%, the dot cannot be corrected to the desired position so the uneven density correction is insufficient. Image position correction has been described above. The same problem arises in the method of correcting the image density as well.

SUMMARY OF THE INVENTION

The present invention can be implemented as, for example, an image forming apparatus. The image forming apparatus comprises a correction unit configured to correct, for uneven density caused by uneven rotation of a rotation speed of a rotation member, image data to reduce the uneven density, and a diffusion unit configured to diffuse, for a pixel of interest whose density exceeds an upper limit of an output density out of pixels of the image data corrected by the correction unit, an excess of the density more than the upper limit to a plurality of peripheral pixels while maintaining a center of gravity of the density.

One aspect of the present invention provides an image forming apparatus comprising: a rotation member concerning image formation; a correction unit configured to correct, for uneven density caused by uneven rotation of a rotation speed of the rotation member, image data to reduce the uneven density; and a diffusion unit configured to diffuse, for a pixel of interest whose density exceeds an upper limit of an output density out of pixels of the image data corrected by the correction unit, an excess of the density more than the upper limit to a plurality of peripheral pixels while maintaining a center of gravity of the density.

Another aspect of the present invention provides an image forming apparatus comprising: a rotation member concerning image formation; a correction unit configured to correct, for uneven density caused by uneven rotation of a rotation speed of the rotation member, image data to reduce the uneven density; and a density conversion unit configured to convert a tone value of a density of each pixel of the image data before or after the correction by the correction unit such that the density does not exceed an upper limit of an output density by the correction of the image data to reduce the uneven density.

Further features of the present invention will become apparent from the following description of exemplary embodiments (with reference to the attached drawings).

BRIEF DESCRIPTION OF THE DRAWINGS

FIGS. 10A to 10D are views showing matrices used in overflow processing;

DESCRIPTION OF THE EMBODIMENTS

Figure 1A:
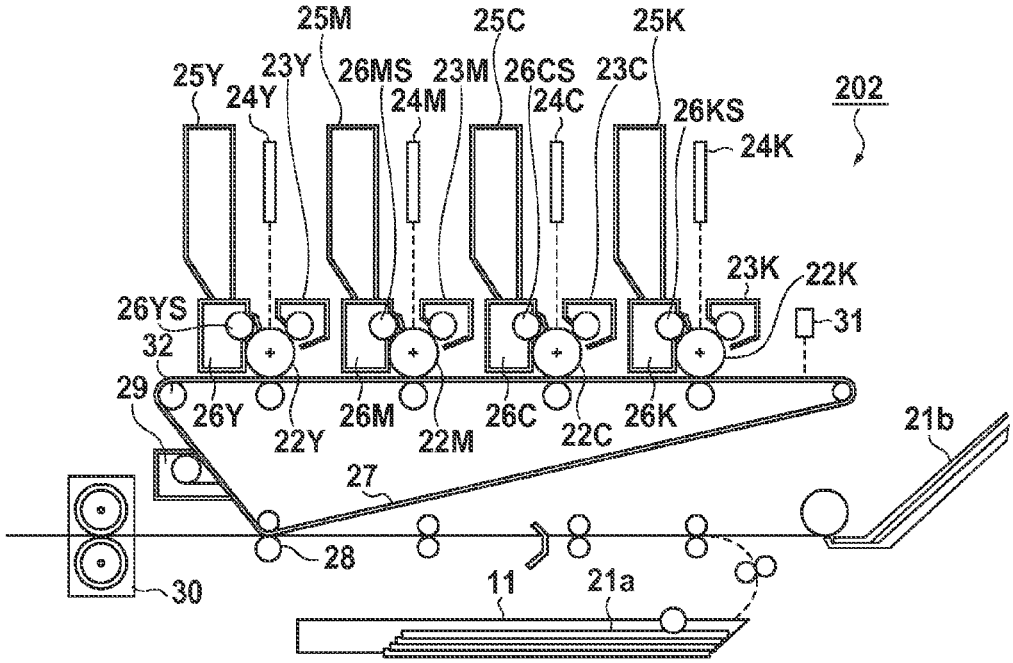
FIGS. 1A and 1B are views showing the arrangement of an image forming apparatus.

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

<Arrangement of Image Forming Apparatus>

The first embodiment of the present invention will now be described with reference to FIGS. 1A to 10D. An image forming apparatus 202 including a four-color image forming unit for yellow Y, magenta M, cyan C, and black K will be explained first with reference to FIG. 1A. The image forming apparatus 202 includes the image forming unit shown in FIG. 1A and an image processing unit (not shown).

The image forming unit includes a paper feeding unit 21, photosensitive drums 22Y, 22M, 22C, and 22K, injection chargers 23Y, 23M, 23C, and 23K, scanner units 24Y, 24M, 24C, and 24K, toner cartridges 25Y, 25M, 25C, and 25K, developing units 26Y, 26M, 26C, and 26K, an intermediate transfer belt 27, a transfer roller 28, and a fixing unit 30. The photosensitive drums (photosensitive members) 22Y, 22M, 22C, and 22K each serving as an image carrier rotate upon receiving driving from a motor (not shown). In this embodiment, uneven density (banding) that occurs in the sub-scanning direction due to the uneven rotation speed of the motor is corrected. The motor rotates the photosensitive drums 22Y, 22M, 22C, and 22K counterclockwise in accordance with an image forming operation. The injection chargers 23Y, 23M, 23C, and 23K for charging the photosensitive drums and the developing units 26Y, 26M, 26C, and 26K for performing development are provided around the photosensitive drums 22Y, 22M, 22C, and 22K, respectively. The developing units are provided with development sleeves 26YS, 26MS, 26CS, and 26KS which rotate upon toner development. The intermediate transfer belt (intermediate transfer material) 27 rotates clockwise as an intermediate transfer belt driving roller 32 (to be referred to as a driving roller hereinafter) rotates. The driving roller 32 rotates upon receiving driving from the motor (not shown). The driving of the intermediate transfer belt 27 is also affected by the uneven rotation speed of the motor, like the photosensitive drums 22.

In image formation, first, the injection chargers 23Y, 23M, 23C, and 23K charge the rotating photosensitive drums 22Y, 22M, 22C, and 22K. After the charging, the scanners 24Y, 24M, 24C, and 24K selectively expose the surfaces of the photosensitive drums 22Y, 22M, 22C, and 22K to form electrostatic latent images. The electrostatic latent images are developed by the developing units 26Y, 26M, 26C, and 26K using toners and thus visualized. The single-color toner images are superimposed and transferred onto the intermediate transfer belt 27 rotating clockwise as the photosensitive drums 22Y, 22M, 22C, and 22K rotate. After that, the transfer roller 28 comes into contact with the intermediate transfer belt 27 to sandwich and convey a transfer material 11 so that the multicolor toner image on the intermediate transfer belt 27 is transferred to the transfer material 11. The transfer material 11 holding the multicolor toner image is heated and pressed by the fixing unit 30 to fix the toner to the surface. After the toner image fixing, the transfer material 11 is discharged to a discharge tray (not shown) by discharge rollers (not shown). The toner remaining on the intermediate transfer belt 27 is removed by a cleaning unit 29. The removed toner is stored in a cleaner container.

Figure 2:
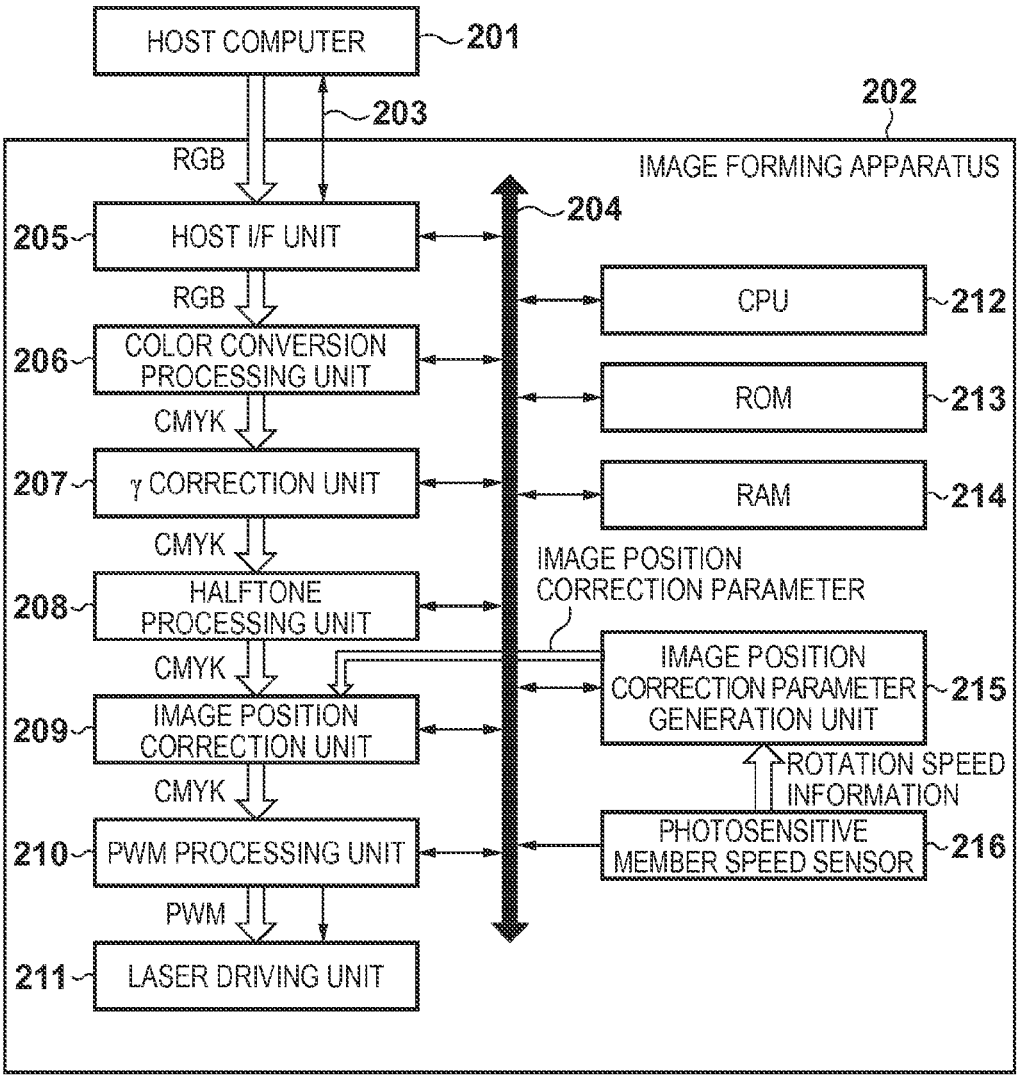
FIG. 2 is a block diagram showing the arrangement of image processing.

Constituent blocks concerning image processing of this embodiment will be described next with reference to FIG. 2. FIG. 2 discriminately illustrates a CPU 212 and the functional blocks. However, the functions of the functional blocks may be imparted to the CPU 212. The functions of the CPU 212 and the functional blocks may be imparted to an ASIC or the like. This also applies to FIGS. 11 and 15 to be described later.

The image forming apparatus 202 includes a host interface (to be referred to as a host I/F hereinafter) unit 205, a color conversion processing unit 206, a γ correction unit 207, a halftone processing unit 208, an image position correction unit 209, a PWM processing unit 210, a laser driving unit 211, the CPU 212, a ROM 213, a RAM 214, an image position correction parameter generation unit 215, and a photosensitive member speed sensor 216. These components are connected via a system bus 204. A host computer 201 and the image forming apparatus 202 are connected via a communication line 203.

The host I/F unit 205 manages data input/output to/from the host computer 201. The CPU 212 controls the entire image forming apparatus 202. The ROM 213 stores control data and control programs to be executed by the CPU 212. The RAM 214 is used as a work memory for print data processing and the like. The image position correction parameter generation unit 215 generates an image position correction parameter to be described later and outputs them to the image position correction unit 209. The photosensitive member speed sensor 216 detects the rotation speeds of the photosensitive drums 22Y, 22M, 22C, and 22K and outputs the rotation speed information to the image position correction parameter generation unit 215 as needed.

The procedure of image processing of this embodiment will be described. When a print operation starts, the host computer 201 outputs RGB image signals, which are input to the image forming apparatus 202 via the host I/F unit 205. The color conversion processing unit 206 performs masking and UCR processing for the input RGB signals to correct the colors and remove the undercolor so that the signals are converted into image signals (CMYK signals) of yellow Y, magenta M, cyan C, and black K. The γ correction unit 207 corrects the CMYK signals to obtain a linear output density curve. The halftone processing unit 208 performs halftone processing using systematic dithering, error diffusion, or the like. The image position correction unit 209 performs image position correction processing (to be described later) for the CMYK signals, which have undergone the halftone processing, using an image position correction parameter. After that, the CMYK signals that have undergone the image position correction processing are subjected to pulse width modulation by the PWM processing unit 210, D/A-converted, and input to the laser driving unit 211. The scanners 24Y, 24M, 24C, and 24K selectively expose the photosensitive drums 22Y, 22M, 22C, and 22K in accordance with the signal input to the laser driving unit 211 to form electrostatic latent images, as described above.

<Arrangement of Density Sensor>

Figure 1B:
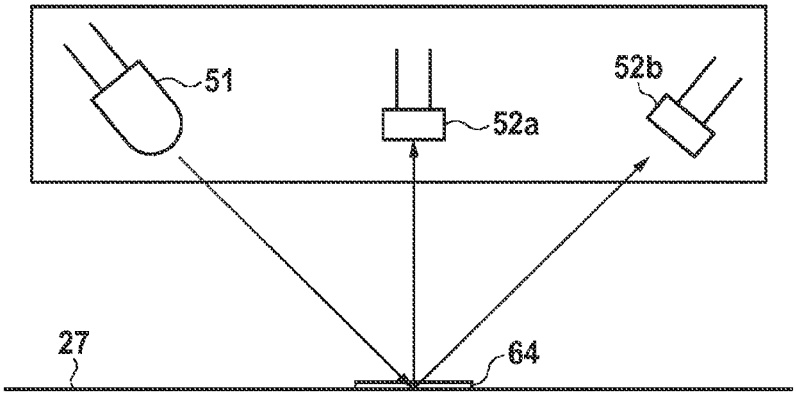

A density sensor 31 shown in FIG. 1A is arranged toward the intermediate transfer belt 27 to measure the density of a toner patch formed on the surface of the intermediate transfer belt 27. FIG. 1B shows an example of the arrangement of the density sensor 31. The density sensor 31 includes an infrared emitting element 51 such as an LED, light receiving elements 52*a* and 52*b* such as photodiodes, and an IC for processing received light data. These components are housed in a holder (not shown).

The infrared emitting element 51 is installed at 45° with respect to the normal direction of the intermediate transfer belt 27 to irradiate a toner patch 64 on the intermediate transfer belt 27 with infrared light. The light receiving element 52*a* detects the intensity of light irregularly reflected by the toner patch 64. The light receiving element 52*b* detects the intensity of light regularly reflected by the toner patch. Detecting both the regularly reflected light intensity and the irregularly reflected light intensity allows to detect the density of the toner patch from high density to low density. Note that the density sensor 31 shown in FIG. 1B may use an optical element such as a lens (not shown) for condensing light.

Image Position Correction Parameter Generation Processing>

Figure 3:
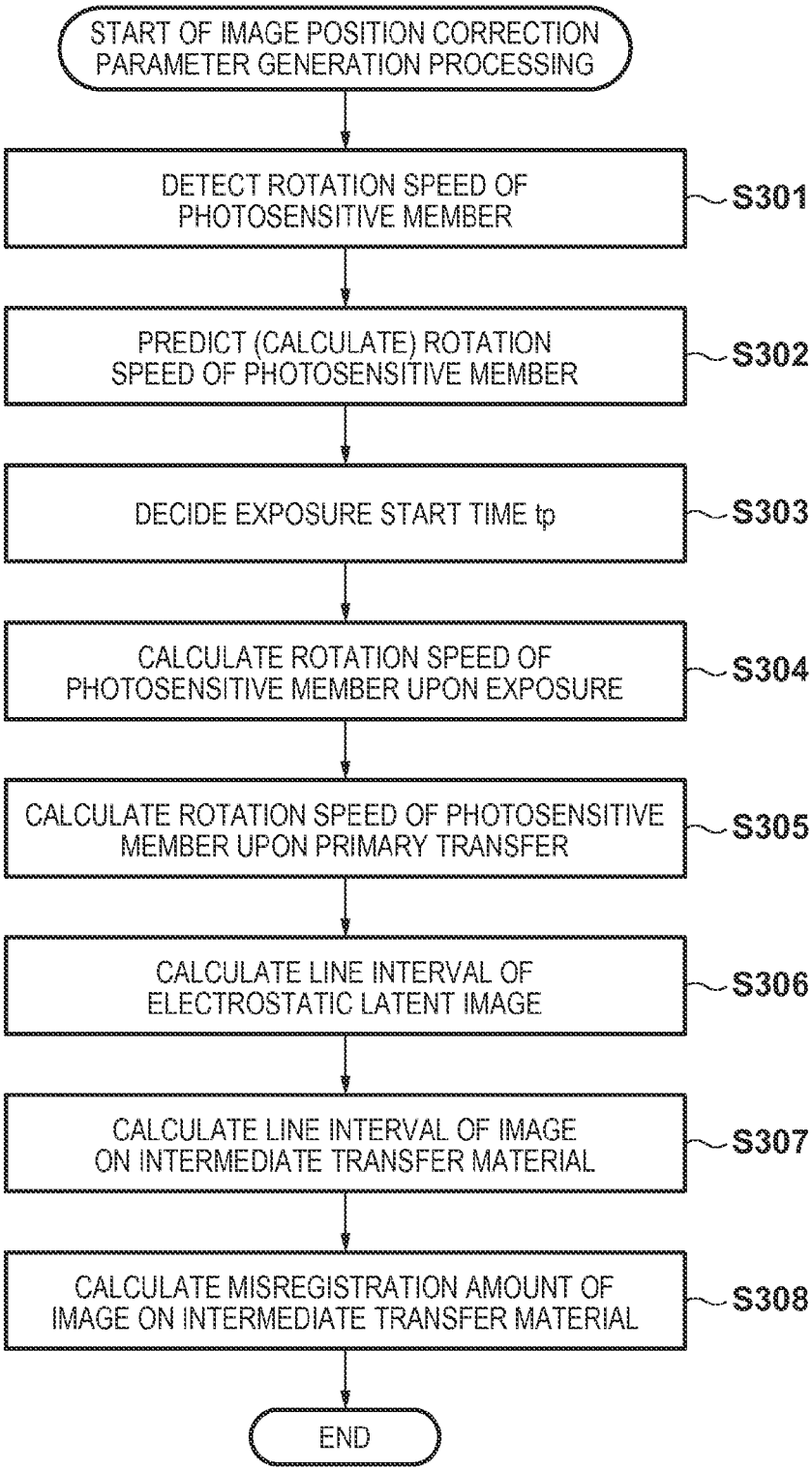
FIG. 3 is a flowchart illustrating the procedure of image position correction parameter generation processing.

A procedure of generating an image position correction parameter to correct uneven density caused by the mechanical factors of a member concerning image formation will be described next with reference to FIG. 3. The image position correction parameter is a parameter to suppress uneven density caused by, for example, the uneven rotation speed of the motor, and represents the image misregistration amount in the sub-scanning direction on the nth scanning line. Note that only processing for the image of yellow Y will be explained below for the sake of simplicity. Actually, the same processing as that for yellow Y is performed for each color of CMYK.

In step S301, the photosensitive member speed sensor 216 detects (measures) the rotation speed of the photosensitive drum 22Y. In this embodiment, the rotation speeds of the photosensitive drums 22Y, 22M, 22C, and 22K are detected by rotary encoders attached to their rotating shafts. Rotation speed detection will be described in detail with reference to FIGS. 4A to 4C.

Figure 4A:
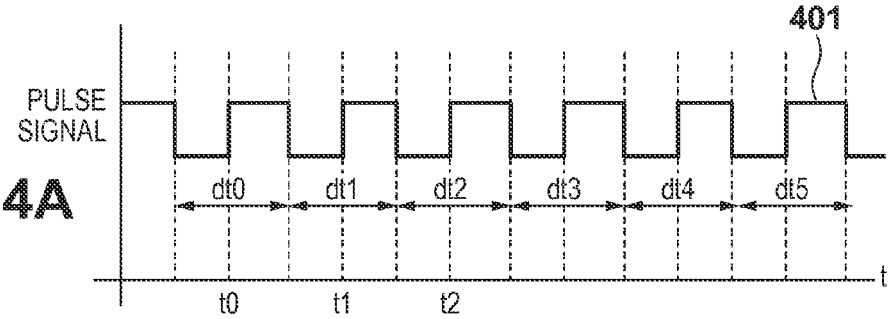
FIGS. 4A to 4C are explanatory views of processing of detecting the speed of a photosensitive drum.

In FIG. 4A, 401 represents an example of an encoder pulse signal output from the rotary encoder. The encoder pulse signal is used to measure the rotation speed of the measurement target rotation member (photosensitive drum 22Y in this case). A one-pulse rectangular wave is output every time the rotation member rotates by a predetermined phase. For example, a rotary encoder that outputs a rectangular wave of p pulses in every rotation of the rotation member outputs a one-pulse rectangular wave every time the rotation member rotates by an amount corresponding to the 1/p period.

An example will be described in which a surface speed Vdo(t) of the photosensitive drum 22Y from time t0 is measured. First, the photosensitive member speed sensor 216 measures a time dt0 necessary for one pulse of the encoder pulse signal 401 output at the time t0. Next, the photosensitive member speed sensor 216 calculates the surface speed Vdo (t0) of the photosensitive drum 22Y by $$Vdo(t0)=(\pi\times R/p)/dt0 \quad (1)$$

where R is the diameter of the photosensitive drum 22Y, and Vdo(t0) is the surface speed of the photosensitive drum 22Y at the time t0.

Figure 4B:
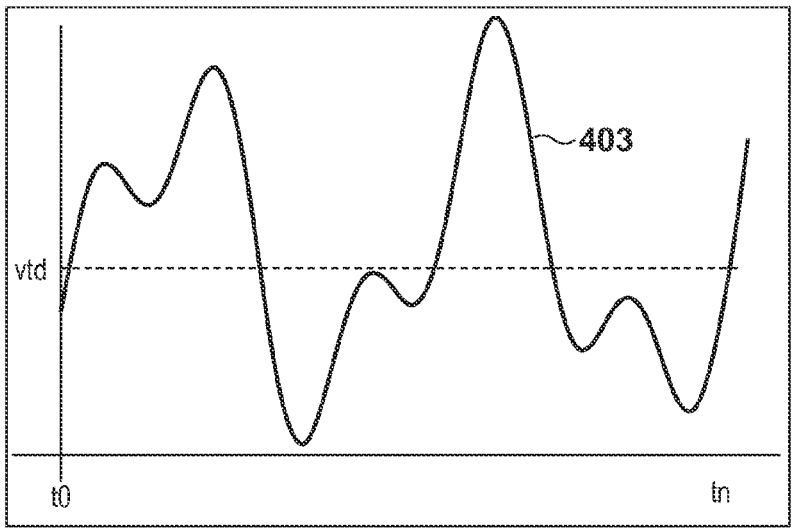

Times dt1, dt2, . . . necessary for subsequent pulses are sequentially acquired, and the same calculation as equation (1) is performed to calculate the photosensitive drum surface speed Vdo(t) at each time. An example of the surface speed Vdo(t) of the photosensitive drum 22Y from time t0 to tn is represented by 403 in FIG. 4B. As shown in FIG. 4B, the photosensitive drum 22Y has uneven speed for a target surface speed Vtd. The graph 403 includes uneven speed (speed components) of various periods and represents a composite waveform.

The rotation speed (regarded as the surface speed) unevenness of the photosensitive drum 22Y mainly includes uneven rotation speed in a photosensitive drum rotation period Td caused by decentering of the photosensitive drum 22Y and uneven rotation speed in a motor rotation period Tm of the motor that drives the photosensitive drum 22Y. Uneven speed caused by, for example, the decentering of the driving gear that transfers the rotation force of the motor may also be included in some cases. In the following explanation, focus is placed especially on the uneven speed in the photosensitive drum rotation period Td and that in the motor rotation period Tm, and uneven density caused by these factors is suppressed. However, uneven density caused by another uneven speed such as uneven speed caused by the decentering of the gear that transfers the rotation force of the motor may be corrected.

Referring back to FIG. 3, in step S302, the image position correction parameter generation unit 215 acquires rotation speed information representing the measurement result from the photosensitive member speed sensor 216, and predicts the rotation speed of the photosensitive drum 22Y at an arbitrary timing t based on the surface speed Vdo(t) of the photosensitive drum 22Y.

The image position correction parameter generation unit 215 extracts uneven speed Vdf(t) in the photosensitive drum rotation period Td from the surface speed Vdo(t) of the photosensitive drum 22Y measured in step S301, and calculates a strength Ad of the uneven speed and an initial phase ϕdt0 of the uneven speed at the time t0. The calculation can be done by, for example, performing Fourier transformation for the surface speed Vdo(t) of the photosensitive drum 22Y and then obtaining the strength and initial phase in the photosensitive drum rotation period Td. The image position correction parameter generation unit 215 also calculates a strength Am of uneven speed Vmf(t) and an initial phase ϕmt0 of the uneven speed at the time t0 in the motor rotation period Tm in a similar manner.

Figure 4C:
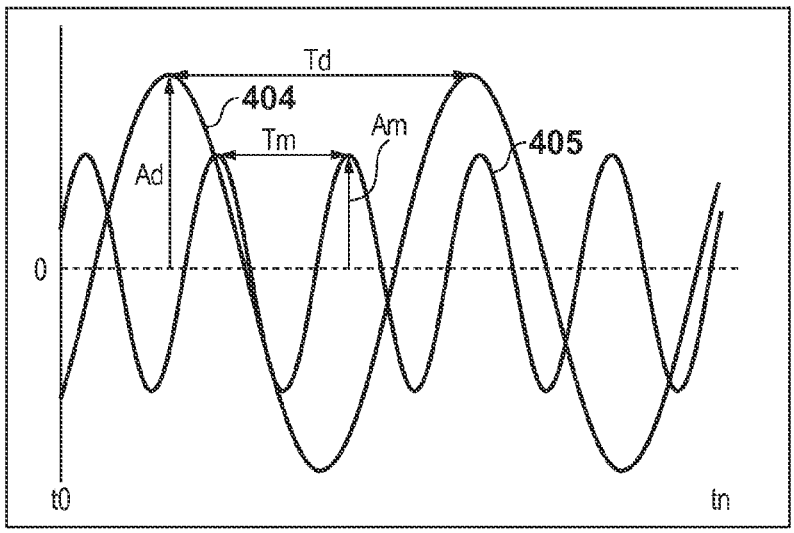

FIG. 4C shows an example of the uneven speed in the periods Td and Tm extracted by the above-described method. In FIG. 4C, 404 represents Vdf(t); and 405, Vmf(t). Based on the calculation result, a speed Vd(t) of the photosensitive drum 22Y at the arbitrary time t can be predicted, which is given by $$Vd(t)=Vtd+Ad\times\cos(\omega d\times t+\phi dt0)+Am\times\cos(\omega m\times t+(\phi mt0)$$

$$\omega d=2\pi/Td,\omega m=2\pi/Tm \quad (2)$$

In equations (2), for the speed Vd(t), the uneven speed in the photosensitive drum rotation period Td and that in the motor rotation period Tm are superimposed with respect to the target surface speed Vtd.

Note that in equations (2), t is used as the parameter. In place of t, the phase of the speed change of the rotation member may be adopted. The speed of the rotation member exhibits a predetermined change in correspondence with the rotation position of the rotation member. Hence, the rotation position (position phase) of the rotation member may be adopted.

Referring back to FIG. 3, in step S303, the CPU 212 determines an exposure start time tp and notifies the image position correction parameter generation unit 215 of it. The exposure start time tp is the time each unit in the image forming apparatus 202 has transited to an image formation enable state, and the image position correction parameter generation processing and image position correction processing to be described later are completed to enable image exposure.

In step S304, the image position correction parameter generation unit 215 calculates a surface speed Ve(t) of the photosensitive drum 22Y at the time of exposure. The surface speed Vd(t) of the photosensitive drum 22Y can directly be used as the surface speed Ve(t). Hence, the surface speed Ve(t) of the photosensitive drum 22Y when exposure is performed at the time t is given by $$Ve(t)=Vd(t) \quad (3)$$

Figure 5:
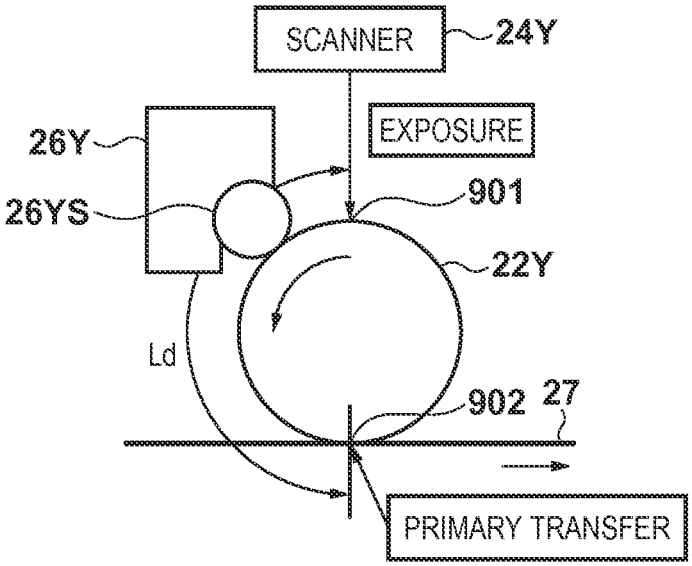
FIG. 5 is a view for explaining exposure, development, and primary transfer.

In step S305, the image position correction parameter generation unit 215 calculates a surface speed Vt(t) of the photosensitive drum 22Y at the time of primary transfer of the image exposed at the time t. The exposed image is developed by the developing unit 26Y and primarily transferred to the intermediate transfer belt 27. FIG. 5 shows this state. The image exposed at an exposure point 901 by the scanner 24Y is conveyed to the position of the developing unit 26Y and developed to a toner image. The developed toner image is conveyed to a primary transfer point 902 and then primarily transferred to the intermediate transfer belt 27.

As described above, a predetermined time elapses from exposure to primary transfer of the image. Based on a distance Ld from the exposure position to the primary transfer position on the surface of the photosensitive drum 22Y and the average surface speed of the photosensitive drum 22Y, a time (exposure transfer time) Δt from exposure to primary transfer is given by $$\Delta t=Ld/Vtd \quad (4)$$

The target surface speed Vtd is usable as the average surface speed of the photosensitive drum 22Y. The exposure transfer time Δt is held in a nonvolatile storage memory (not shown). The image position correction parameter generation unit 215 refers to the information Δt when necessary. The value of the distance Ld may change between the main bodies because the exposure position changes due to the influence of the attachment position error of the scanner 24Y and the like. For this reason, in this embodiment, the distance Ld is preferably measured for each main body and held in the nonvolatile memory (not shown) in the image forming apparatus manufacturing step.

Using the exposure transfer time Δt, the image position correction parameter generation unit 215 calculates the surface speed Vt(t) of the photosensitive drum 22Y when primarily transferring the image exposed at the time t by $$Vt(t)=Vd(t+\Delta t) \quad (5)$$

In step S306, the image position correction parameter generation unit 215 calculates the line interval of an electrostatic latent image. The scanner 24Y performs exposure scanning at a predetermined scanning interval is so as to form an electrostatic latent image at a predetermined target line interval W when the photosensitive drum 22Y rotates at the target surface speed Vtd. W is the interval of scanning lines. Letting pd_res [dpi] be the resolution in the photosensitive drum rotation direction, the line interval W is about 25.4/pd_res [mm].

Especially when a conveyance speed Vb of the intermediate transfer belt 27 equals the target surface speed Vtd of the photosensitive drum 22Y, the interval of images formed on the intermediate transfer belt 27 can be represented by W. For the descriptive convenience, in this embodiment, $$Vb=Vtd \quad (6)$$

The image position correction parameter generation unit 215 calculates the scanning interval ts by, for example, $$ts=W/Vtd \quad (7)$$

Figure 6A:
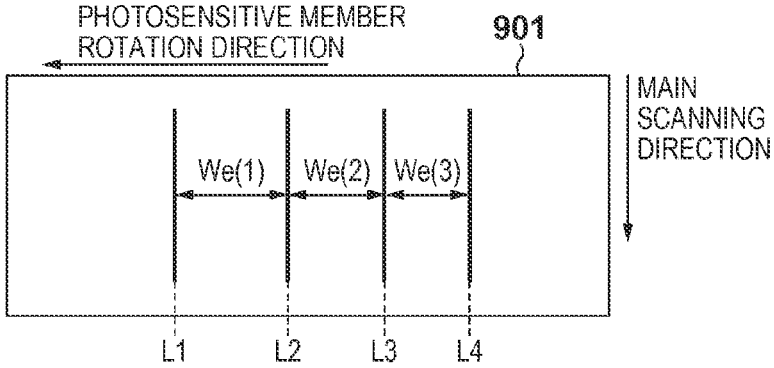
FIGS. 6A to 6D are views for explaining the interval of scanning lines of an image.

FIG. 6A shows an example in which the formation of electrostatic latent images at the exposure point 901 is viewed from the side of the scanner 24Y (upper side). In FIG. 6A, an electrostatic latent image L1 is formed at the exposure start time tp, an electrostatic latent image L2 is formed at a time (tp+ts), an electrostatic latent image L3 is formed at a time (tp+2ts), and an electrostatic latent image L4 is formed at a time (tp+3ts). At this time, the image position correction parameter generation unit 215 calculates an interval We(1) between the electrostatic latent images L1 and L2, an interval We(2) between the electrostatic latent images L2 and L3, and an interval We(n) between arbitrary electrostatic latent images Ln and (Ln+1) in the following way.

The electrostatic latent image L1 is formed at the time tp, and the electrostatic latent image L2 is formed at the time (tp+ts). For this reason, the interval We(1) is equivalent to the moving distance of the surface of the photosensitive drum 22Y from the time tp to (tp+ts). Hence, the definite integral value of Ve(t) from the time tp to (tp+ts) is calculated. Since the scanning interval ts is sufficiently short, the speed of the photosensitive drum 22Y from the time tp to (tp+ts) is approximated by Ve(tp) to calculate $$We(1)\approx Ve(tp)\times ts$$

$$We(2)\approx Ve(tp+ts)\times ts$$

$$We(n)\approx Ve(tp+(n-1)ts)\times ts \quad (8)$$

In step S307, the image position correction parameter generation unit 215 calculates the line interval of the image primarily transferred onto the intermediate transfer belt 27. As described above, the electrostatic latent image is developed by the developing unit 26Y and conveyed to the primary transfer point 902. At the primary transfer point 902, the image is primarily transferred to the intermediate transfer belt 27.

Figure 6B:
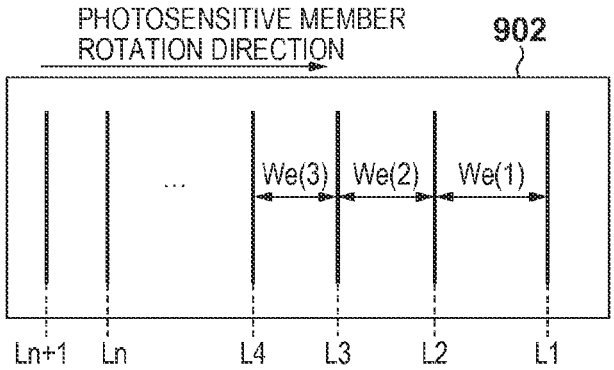

FIG. 6B shows an example in which conveying the images exposed in FIG. 6A to the primary transfer point 902 is viewed from the side of the exposure apparatus (upper side). The same reference symbols as in FIG. 6A denote the same images. The intervals between the lines are the same as the line intervals of the electrostatic latent images calculated in step S306. An interval Wt(1) between the primarily transferred images L1 and L2 can be calculated as the moving distance of the intermediate transfer belt 27 during the time from primary transfer of the image L1 to primary transfer of the image L2 spaced apart by the distance We(1).

The time that elapses from primary transfer of the image L1 to primary transfer of the image L2 spaced apart by the distance We(1) is calculated, based on We(1) and the speed Vt(t) of the photosensitive drum 22Y at the time of transfer, as x with which the definite integral value of Vt(t) from the time tp to (tp+x) becomes We(1). However, since x is sufficiently short, the speed of the photosensitive drum 22Y from the time tp to (tp+x) is approximated by Vt(tp) to calculate $$x \approx We(1)/Vt(tp) \tag{9}$$

Wt(1) can be obtained, using the conveyance speed Vb of the intermediate transfer belt 27, by Wt(1)=x×Vb. Hence, the intervals are calculated by $$Wt(1) \approx We(1)/Vt(tp) \times Vb$$

$$Wt(2) \approx We(2)/Vt(tp+ts) \times Vb$$

$$Wt(n) \approx We(n)/Vt(tp+(n-1)ts) \times Vb \tag{10}$$

Wt(n) can also be calculated in the same way.

Figure 6C:
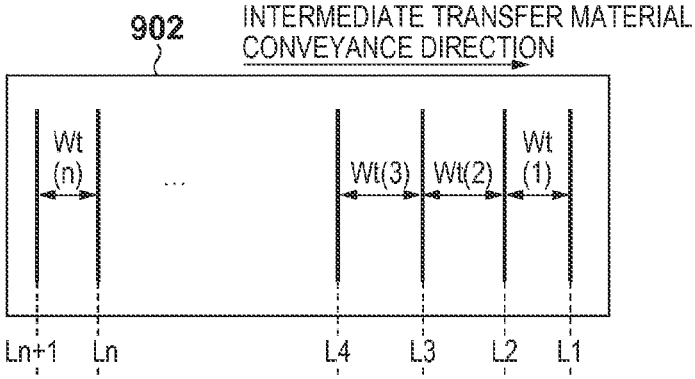

FIG. 6C shows an example of the images on the intermediate transfer belt 27 after primary transfer. The same reference symbols as in FIGS. 6A and 6B denote the same images in FIG. 6C. A change (unevenness) occurs in the line intervals of the images on the intermediate transfer belt 27 due to the uneven speed of the photosensitive drum 22Y. Uneven density occurs in the images due to this change.

Figure 6D:
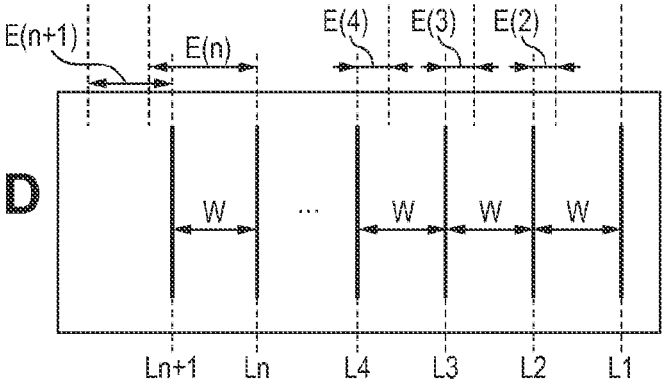

FIG. 6D shows an example of ideal images without the change in the line intervals. The same reference symbols as in FIGS. 6A, 6B, and 6C denote the same images in FIG. 6D. The image L1 in FIG. 6D is primarily transferred at the same position as that of the image L1 in FIG. 6C. The subsequent images are primarily transferred at the predetermined distance W. If the line interval can be the predetermined distance W, as shown in FIG. 6D, the change in the line intervals can be reduced, and uneven density does not occur.

In this embodiment, image position correction is performed for images to be primarily transferred, as shown in FIG. 6C, so that they are apparently primarily transferred at a predetermined interval, as shown in FIG. 6D, thereby suppressing uneven density. That is, in this embodiment, the forming position of each line (image) in the sub-scanning direction is adjusted in consideration of the extracted uneven speed so as to form the lines at a predetermined interval, as shown in FIG. 6D.

Referring back to FIG. 3, in step S308, the image position correction parameter generation unit 215 calculates (predicts) the misregistration amount (image position correction parameter) of the image primarily transferred onto the intermediate transfer belt 27 from its ideal state. The misregistration amount here represents the misregistration amount of each scanning line in the sub-scanning direction. The misregistration amount is calculated based on the image L1. Hence, for the image L1, a misregistration amount E(1)=0.

A misregistration amount E(2) of the image L2, a misregistration amount E(3) of the image L3, and a misregistration amount E(n) of the arbitrary image Ln are given by $$E(2)=W-Wt(1)$$

$$E(3)=2W-\{Wt(1)+Wt(2)\}=E(2)+\{W-Wt(2)\}$$

$$E(n)=E(n-1)+\{W-Wt(n-1)\} \tag{11}$$

When E(n) is a positive value, it represents that the image is shifted in the conveyance direction of the intermediate transfer belt 27 relative to the ideal state. When E(n) is a negative value, it represents that the image is shifted in the direction reverse to the conveyance direction of the intermediate transfer belt 27. The image position correction parameter generation processing thus ends.

Measuring the misregistration amounts E(n) in real time in the image forming apparatus has been described with reference to the flowchart of FIG. 3. However, the misregistration amounts may be measured in the factory where the image forming apparatus is manufactured. In this case, a mark is put on the photosensitive member that is a rotation member, and the misregistration amounts E(n) measured based on the mark in the factory are stored in the ROM 213. The image forming apparatus sequentially reads out, from the ROM 213, the misregistration amounts E(n) stored in advance based on the mark detection timing as the photosensitive member rotates upon printing.

<Image Position Correction Processing>

Figure 7:
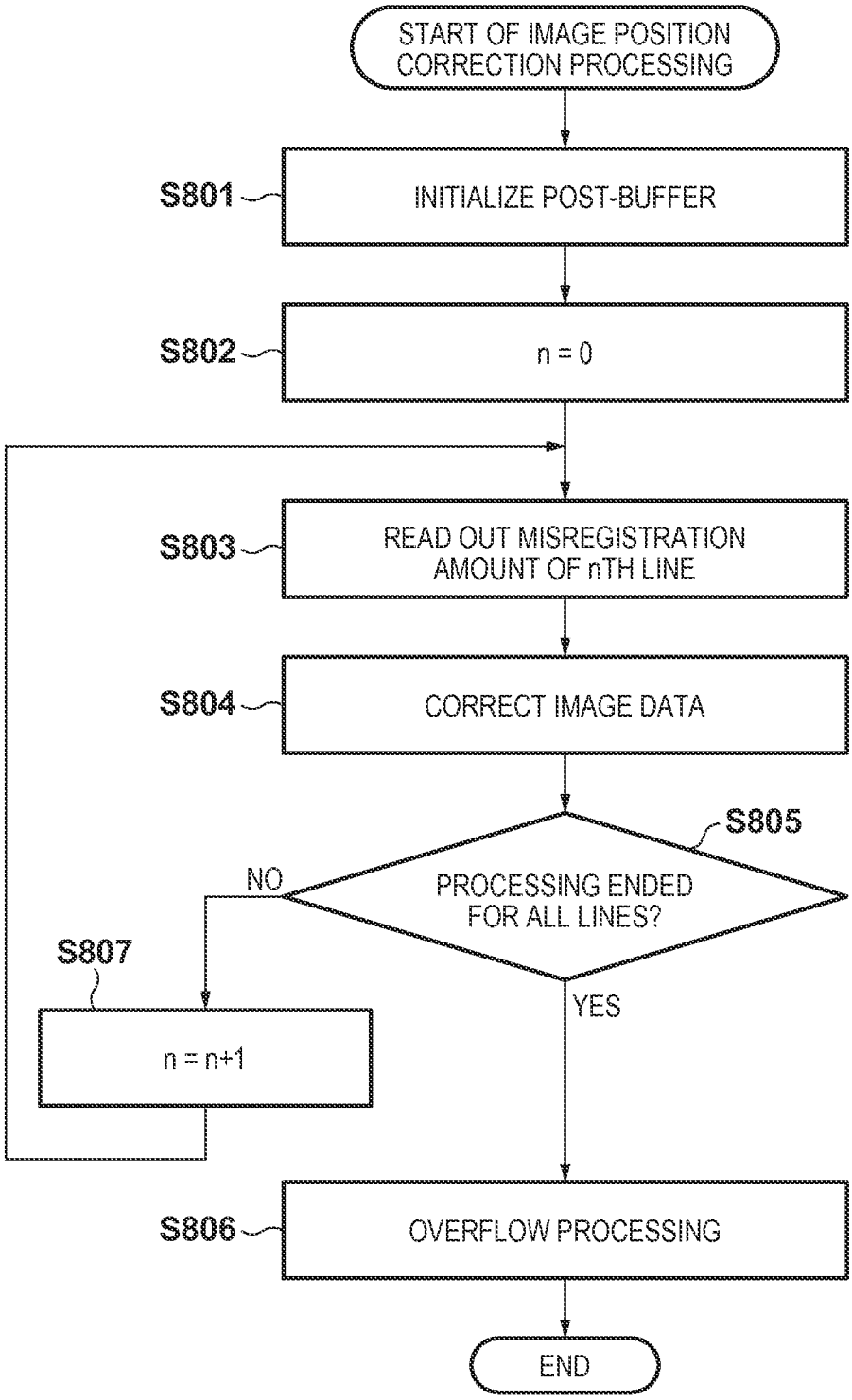
FIG. 7 is a flowchart illustrating the procedure of image position correction processing.

Image position correction processing according to this embodiment will be explained next with reference to FIG. 7. In the image position correction processing, image data is corrected to shift the forming position of the image corresponding to the image data using the image position correction parameter described with reference to FIG. 3. The image forming apparatus of this embodiment independently includes a buffer (prebuffer) for storing halftone-processed image data before image position correction and a buffer (post-buffer) for storing image data after image position correction. Note that during the image position correction processing, only image data in the post-buffer is rewritten, and the image data in the prebuffer remains unchanged.

When image position correction processing starts, in step S801, the image position correction unit 209 initializes the post-buffer to 0. In step S802, the image position correction unit 209 initializes a counter n that counts a line (line of interest) under processing to 0. In step S803, the image position correction unit 209 reads out the misregistration amount E(n) of the nth line, that is, the image position correction parameter from the image position correction parameter generation unit 215. The image position correction unit 209 of this embodiment corrects the image position shift by moving the image of the nth line by −E(n). That is, in this embodiment, the image position shift that occurs due to the uneven rotation speed of the motor of the photosensitive drum or the like is corrected by shifting the image in the direction in which the misregistration amount is reduced, that is, in the direction opposite to the shift.

Figure 8:
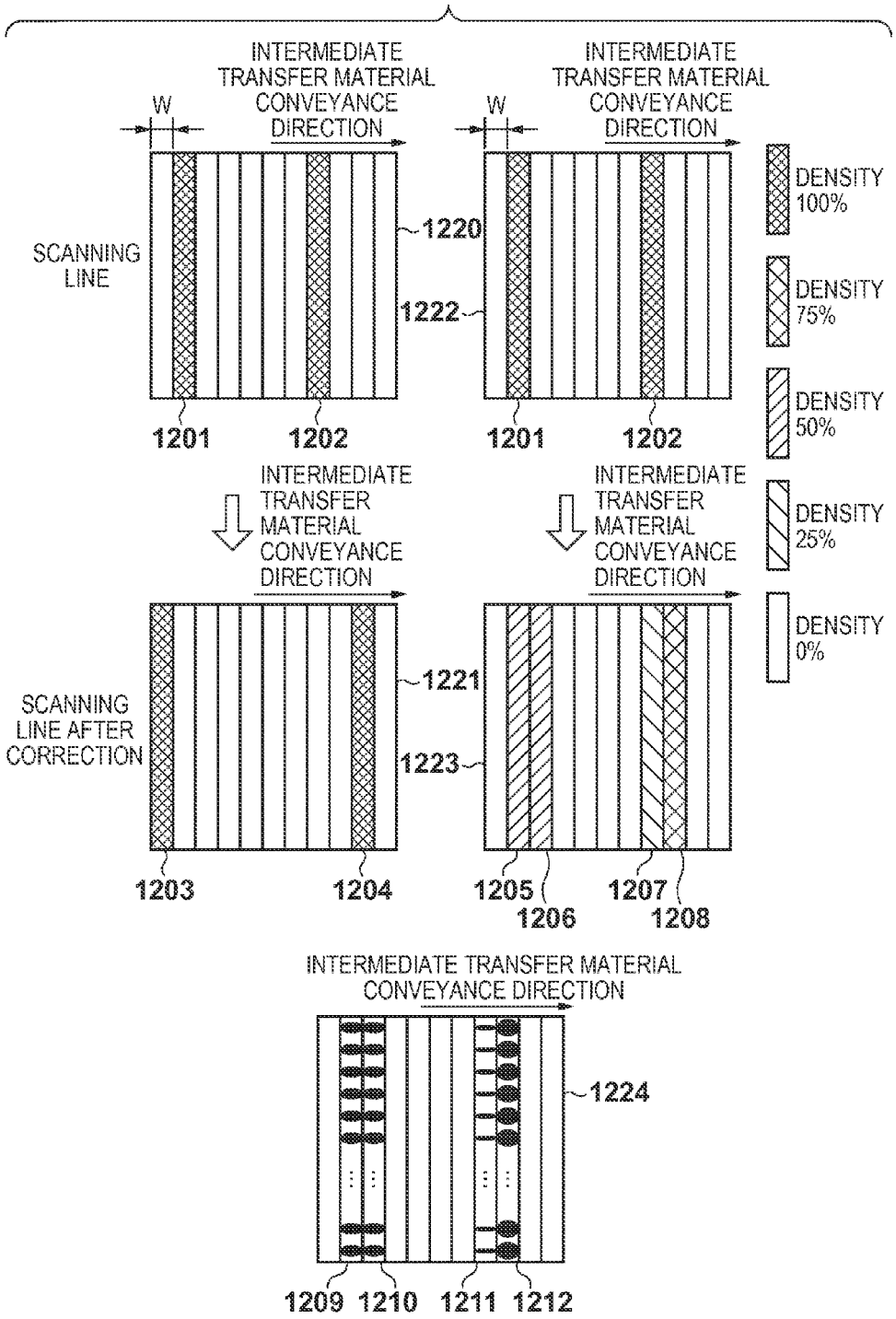
FIG. 8 is an explanatory view of image position correction.

Details of image position correction will be described here with reference to FIG. 8. In FIGS. 8, 1220 and 1221 represent image position correction on the line basis. Assume that the position of a line 1201 is corrected by −W, and the position of a line 1202 is corrected by 2 W. In this case, the line 1201 is moved by one line in the direction reverse to the conveyance direction of the intermediate transfer belt 27, as indicated by 1203, and the line 1202 is moved by two lines in the conveyance direction of the intermediate transfer belt 27, as indicated by 1204, thereby performing correction.

In FIGS. 8, 1222 and 1223 represent image position correction in a unit less than a line. Assume that the position of the line 1201 is corrected by 0.5 W, and the position of the line 1202 is corrected by 0.75 W. In this case, as indicated by 1205 and 1206, 50% of the density of pixels that form the line 1201 is assigned to the line 1205, and the remaining 50% is assigned to the line 1206. In addition, as indicated by 1207 and 1208, 25% of the density of pixels that form the line 1202 is assigned to the line 1207, and the remaining 75% is assigned to the line 1208. When exposure is performed in this state, toner images are formed at positions corresponding to the density ratios, as indicated by 1224. The position of an image 1209 can be corrected by 0.5 W, and the position of an image 1210 can be corrected by 0.75 W.

Let Pi(x, n) be the density value of the xth pixel of the nth line in the prebuffer. At this time, a correction pixel density value Po(x, n) in the post-buffer can be calculated by $$lt=\mathrm{floor}(-E(n)/W)$$

$$\alpha=-E(n)/W-lt,\beta=1-\alpha$$

$$Po(x,n+lt)=Po(x,n+lt)+Pi(x,n)\times\beta$$

$$Po(x,n+lt+1)=Po(x,n+lt+1)+Pi(x,n)\times\alpha \quad (12)$$

In equations (12), the portion where lt is added to n of Pi(x, n) represents image position correction on the line image basis. On the other hand, "×β" and "×α" represent image processing of moving the center of gravity of the image, and this enables image position correction in a unit less than a line. Note that since the post-buffer is initialized to 0 in step S802, as described above, the initial value of Po(x, n) is Po(x, n)=0.

In equations (12), floor(x) is a function for obtaining the maximum integer equal to or smaller than x and represents round-off to an integer in the negative infinite direction. For example, when (−E(n)/W)=1.6, $lt=1,\alpha=0.6,\beta=0.4$, and $$Po(x,n+1)=Po(x,n+1)+Pi(x,n)\times 0.4$$

$$Po(x,n+2)=Po(x,n+2)+Pi(x,n)\times 0.6$$

In this way, 60% of the input image density value is assigned to the position shifted in the conveyance direction of the intermediate transfer belt 27 by two lines, and 40% is assigned to the position shifted in the conveyance direction of the intermediate transfer belt 27 by one line. This makes it possible to form the toner image after exposure at the position shifted by 1.6 lines (1.6 W).

Referring back to FIG. 7, in step S804, the image position correction unit 209 calculates the correction image data Po using equations (12) and corrects the image data. At this time, the image data storage position is changed in accordance with lt of equations (12), and the stored image density value is corrected in accordance with α and β. After that, in step S805, the image position correction unit 209 determines whether the processing has ended for all lines. If the processing has ended, the process advances to step S806. Otherwise, the process advances to step S807.

If the processing has not ended, the image position correction unit 209 increments the counter n in step S807 and returns the process to step S803. If the processing has ended, the image position correction unit 209 performs overflow processing to be described later in detail with reference to FIG. 9 in step S806 and ends the image position correction processing.

The image data that has undergone the overflow processing is input to the PWM processing unit 210, and the photosensitive drums 22Y, 22M, 22C, and 22K are selectively exposed to form electrostatic latent images, as described above.

<Details of Overflow Processing>

Figure 9:
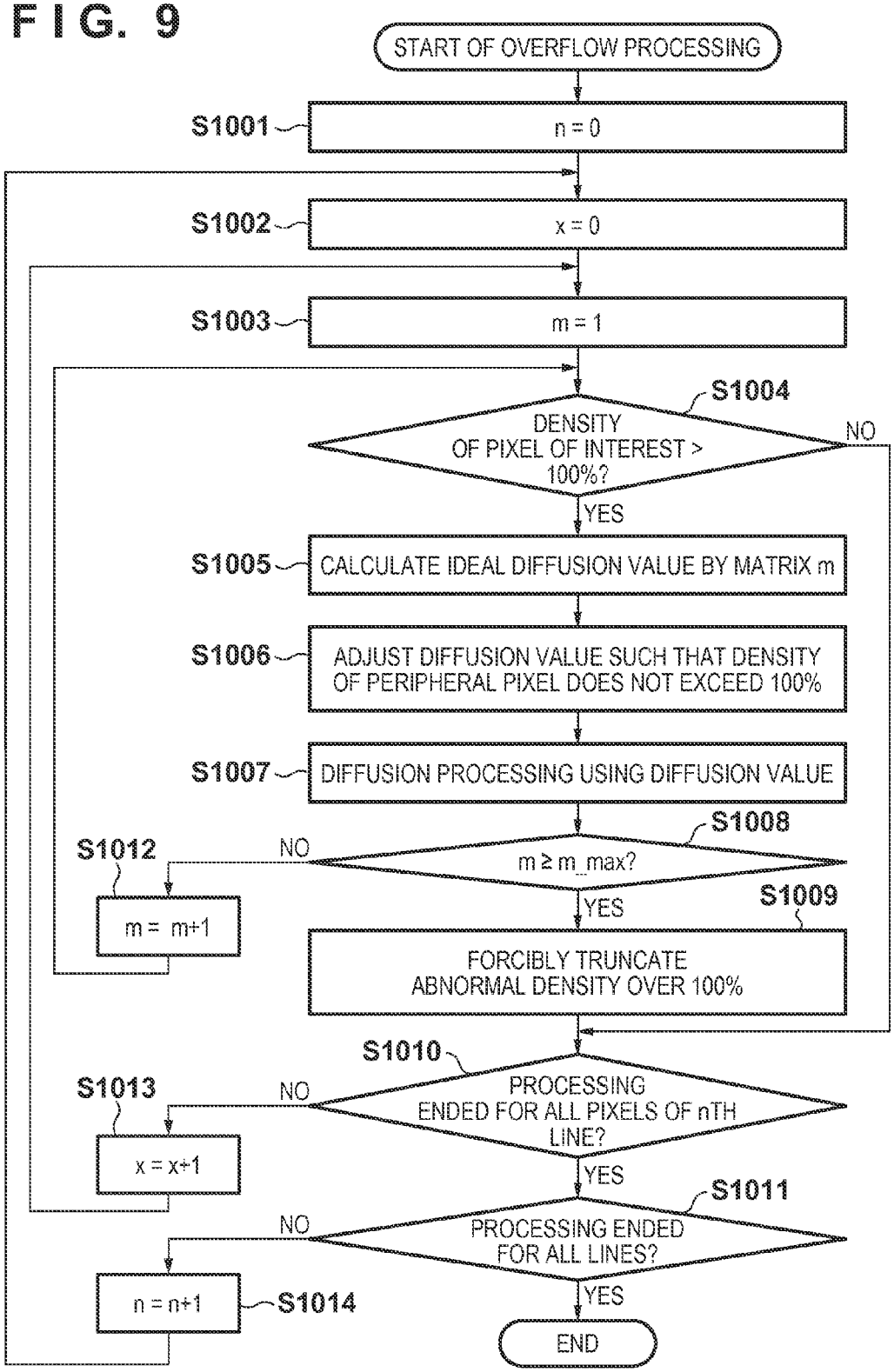
FIG. 9 is a flowchart illustrating the procedure of overflow processing.

Overflow processing will be described next with reference to FIG. 9. In the overflow processing, for a density excess pixel that has obtained a density more than 100% that is the upper limit of the output density upon executing the image position correction processing, the excess is diffused to peripheral pixels while maintaining the center of gravity (center) of the density. Note that the overflow processing is applied to all pixels of the image data that has undergone the image position correction. The pixels can be processed in any order. In this embodiment, a line image is wholly processed, and the next line is then processed.

When overflow processing starts, in step S1001, the image position correction unit 209 initializes the counter n that counts a line under processing to 0. In step S1002, the image position correction unit 209 initializes a counter x representing the position of a pixel of interest in the main scanning direction on the nth line to 0. x=0 indicates the leftmost position of the nth line. Processing is performed by sequentially moving the pixel of interest from left to right of the line. In step S1003, the image position correction unit 209 initializes a counter m representing a matrix currently used in the overflow processing to 1. The matrix according to this embodiment defines a diffusion method (excess diffusion ratio) for diffusing the excess density over 100% in the pixel of interest to peripheral pixels.

There are a plurality of matrices, and the number of matrices is m_max. In this embodiment, m_max=4. FIG. 10A shows four matrices 1 to 4 as examples of matrices according to this embodiment. Matrices 1 to 4 are stored in the ROM 213 or the like in advance. The center of each matrix corresponds to the pixel of interest. Co_a, Co_b, Co_c, and Co_d are coefficients of matrix 1. Co_e, Co_f, Co_g, and Co_h are coefficients of matrix 2. Co_i, Co_j, Co_k, and Co_l are coefficients of matrix 3. Co_m, Co_n, Co_p, and Co_q are coefficients of matrix 4. The coefficients Co_a to Co_q are predetermined values. Matrices 1 to 4 have the coefficients at different positions. The distance between the coefficients and the pixel of interest increases in the order of matrices 1, 2, 3, and 4. That is, for diffusion to closer pixels, matrices 1, 2, 3, and 4 are used in this order. With this arrangement, the excess density is diffused to pixels as close as possible so that the image after diffusion becomes faithful to that before diffusion as much as possible.

When the initialization processing in steps S1001 to S1003 ends, the image position correction unit 209 determines in step S1004 whether the density of the pixel of interest exceeds 100%. If the density is not more than 100%, the overflow processing for the pixel of interest is not performed, and the process advances to step S1010. If the density of the pixel of interest is more than 100%, values (diffusion values) to be diffused to peripheral pixels are calculated using the matrix m in the following way. A calculation method using matrix 1 will be described below as an example. The same calculation method as that for matrix 1 can be applied to matrices 2 to 4.

FIG. 10B is a view showing pixel positions. The position of the pixel of interest is represented by o, the position of the upper pixel by a, the position of the left pixel by b, the position of the lower pixel by c, and the position of the right pixel by d. In step S1005, the image position correction unit 209 multiplies the pixel densities at the positions a, b, c, and d after image position correction by the coefficients of matrix 1, thereby calculating ideal diffusion values. Let Po_o, Po_a, Po_b, Po_c, and Po_d be the pixel densities at the positions o, a, b, c, and d after image position correction, respectively. Let Co_a, Co_b, Co_c, and Co_d be the coefficients at the positions a, b, c, and d of matrix 1, respectively. Ideal diffusion values Df0__*a*, Df0__*b*, Df0__*c*, and Df0__*d* at the positions a, b, c, and d are given by $$Df0__a=Co__a\times Po__a$$

$$Df0__b=Co__b\times Po__b$$

$$Df0_c=Co_c\times Po_c$$

$$Df0_d=Co_d\times Po_d \quad (13)$$

When the excess density is diffused to the peripheral pixels using the ideal diffusion values, the densities after diffusion may exceed 100%. To prevent this, in step S1006, the image position correction unit 209 performs scaling adjustment of the diffusion values not to cause overflow of the peripheral pixels around the pixel of interest. When scaling adjustment of the diffusion values is executed, the density of the pixel of interest is more than 100% even after diffusion. The density that remains without being diffused is diffused to farther pixels using other matrices 2 to 4.

A method of obtaining a scaling coefficient to be used for scaling adjustment of ideal diffusion values will be explained. First, differences Mg_a, Mg_b, Mg_c, and Mg_d between the density of 100% and the pixel densities at the positions a, b, c, and d are obtained by $$Mg_a=100\%-Po_a$$

$$Mg_b=100\%-Po_b$$

$$Mg_c=100\%-Po_c$$

$$Mg_d=100\%-Po_d \quad (14)$$

Next, ratios Sd_a, Sd_b, Sd_c, and Sd_d between Mg_a, Mg_b, Mg_c, and Mg_d and the ideal diffusion values Df0_*a*, Df0_*b*, Df0_*c*, and Df0_*d* are obtained by $$Sd_a=Mg_a/Df0_a$$

$$Sd_b=Mg_b/Df0_b$$

$$Sd_c=Mg_c/Df0_c$$

$$Sd_d=Mg_d/Df0_d \quad (15)$$

As the scaling coefficient, the minimum value of Sd_a, Sd_b, Sd_c, and Sd_d is obtained by $$Sd=\min(1,Sd_a,Sd_b,Sd_c,Sd_d) \quad (16)$$

However, if all of Sd_a, Sd_b, Sd_c, and Sd_d exceed 1, the scaling coefficient is set to 1. The scaling coefficient is represented by Sd. Note that in equations (15), min is a function for obtaining the minimum value of arguments.

The ideal diffusion values are multiplied by the scaling coefficient Sd to obtain actual diffusion values Df_a, Df_b, Df_c, and Df_d at the positions a, b, c, and d as $$Df_a=Sd\times Df0_a$$

$$Df_b=Sd\times Df0_b$$

$$Df_c=Sd\times Df0_c$$

$$Df_d=Sd\times Df0_d \quad (17)$$

Referring back to FIG. 9, in step S1007, the image position correction unit 209 performs diffusion processing in accordance with the diffusion values obtained by equations (17). Densities Po_o', Po_a', Po_b', Po_c', and Po_d' at the positions o, a, b, c, and d after diffusion are obtained by $$Po_a'=Po_a+Df_a$$

$$Po_b'=Po_b+Df_b$$

$$Po_c'=Po_c+Df_c$$

$$Po_d'=Po_d+Df_d$$

$$Po_o'=Po_o-(Df_a+Df_b+Df_c+Df_d) \quad (18)$$

After that, in step S1008, the image position correction unit 209 determines whether m≥m_max, that is, whether a matrix unused for the processing remains. If a matrix remains, the process advances to step S1012 to increment m, and the process returns to step S1004. If no matrix remains, the process advances to step S1009. With the loop processing of step S1008, the excess density is preferentially diffused to peripheral pixels closer to the pixel of interest. This allows to obtain an effect of maintaining the balance of density.

In step S1009, the image position correction unit 209 forcibly truncates the density over 100% in the pixel of interest. In most cases, the density to be truncated is small as compared to the case in which the overflow processing is not performed because the density over 100% is diffused to the peripheral pixels using matrices 1 to 4. That is, in step S1009, if the density of the pixel of interest is still higher than 100% after it is diffused to the peripheral pixels using matrices 1 to 4, the excess is truncated.

The image position correction unit 209 then determines in step S1010 whether the overflow processing has ended for all pixels of the nth line. If the processing has not ended, the process advances to step S1013 to increment the counter x, and the process returns to step S1003. On the other hand, if the processing of the nth line has ended, the process advances to step S1011. The image position correction unit 209 determines whether the overflow processing has ended for all lines. If the processing has not ended, the process advances to step S1014 to increment the counter n, and the process returns to step S1002. On the other hand, if the processing has ended, the overflow processing ends.

According to this embodiment, the coefficients (ratios) of matrices 1 to 4 are preferably weighted to be point-symmetrical with respect to the pixel of interest. In, for example, matrix 1, the coefficients are Co_a=Co_c, and Co_b=Co_d. This prevents the center of gravity of a density from being shifted after overflow processing and the correction position in image position correction processing from being shifted. The number of matrices needs not always be four, and an arbitrary number of matrices are usable. The matrix shapes are not limited to those shown in FIG. 10A if the conditions of the coefficients can be satisfied.

FIG. 10C shows the value of the coefficients of matrices 1 and 2. FIG. 10D shows the pixel density values before overflow processing, those after diffusion processing using matrix 1, and those after diffusion processing using matrix 2. The center of each image corresponds to the pixel of interest.

As shown in FIG. 10D, the density of the pixel of interest after the image position correction processing is 112%. Hence, the density exceeds the upper limit of the output density by 12%. The image position correction unit 209 first uniformly diffuses the density of the pixel of interest to the peripheral pixels using matrix 1. Since the coefficient of matrix 1 is ¼, 12%/4=3% is diffused to each peripheral pixel. However, when 3% is diffused, the density of a peripheral pixel exceeds 100%. Hence, the image position correction unit 209 diffuses the density (2% in this case) to the peripheral pixels such that their densities do not exceed 100%. The diffusion amount is decreased to diffuse 2% to each of the four peripheral pixels. A density of 8% is diffused in total. The density (tone value) of the pixel of interest after matrix 1 is applied is 104%, and diffusion processing is still necessary.

The image position correction unit 209 then diffuses, using matrix 2, the excess with respect to the upper limit of the output density of the pixel of interest, which remains without being diffused. In the diffusion using matrix 2, the distance between the pixel of interest and the peripheral pixels (different from those when matrix 1 is used) of the diffusion destinations is longer than in the preceding diffusion using matrix 1. Matrix 2 is used after the use of matrix 1 to diffuse the excess density to the pixels as close as possible so that the image after diffusion becomes faithful to that before diffusion as much as possible.

Referring back to matrix 2, since the coefficient of matrix 2 is ¼, and the excess is 4%, the density diffused to each peripheral pixel is 1%. When 1% is diffused to each peripheral pixel, none of the peripheral pixels has a density more than 100%. For this reason, the image position correction unit 209 directly diffuses 1% to each peripheral pixel. The density of the pixel of interest after matrix 2 is applied is 100%, and the overflow processing ends. Note that if the density of the pixel of interest is, for example, 103%, the matrices used in this embodiment are not convenient. Hence, the excess of 3% may simply be truncated.

As described above, it is possible to cope with the problematic existence of a pixel having a density more than 100% after image position correction is executed to reduce uneven density caused by the mechanical factors of members concerning image formation. That is, the image forming apparatus according to this embodiment can effectively correct uneven density by diffusing an excess over 100% to the peripheral pixels.

Second Embodiment

In the first embodiment, an example has been described in which image position correction is executed in accordance with the image position correction parameter, and after that, diffusion processing (anti-overflow processing) to peripheral pixels is executed for a pixel whose density exceeds 100%. In the second embodiment, a case will be explained in which the maximum density itself is lowered instead of performing the diffusion processing. The second embodiment will be described below with reference to FIGS. 11 to 15. Note that the same reference numerals as in the first embodiment denote the same parts in the second embodiment, and a description thereof will be omitted. Processing up to step S806 in FIG. 7 of the first embodiment corresponds to processing before anti-overflow processing. This processing applies to the second embodiment, and a detailed description of that portion will be omitted. Processing concerning anti-overflow processing unique to the second embodiment will mainly be described below.

<Arrangement of Image Forming Apparatus>

Figure 11:
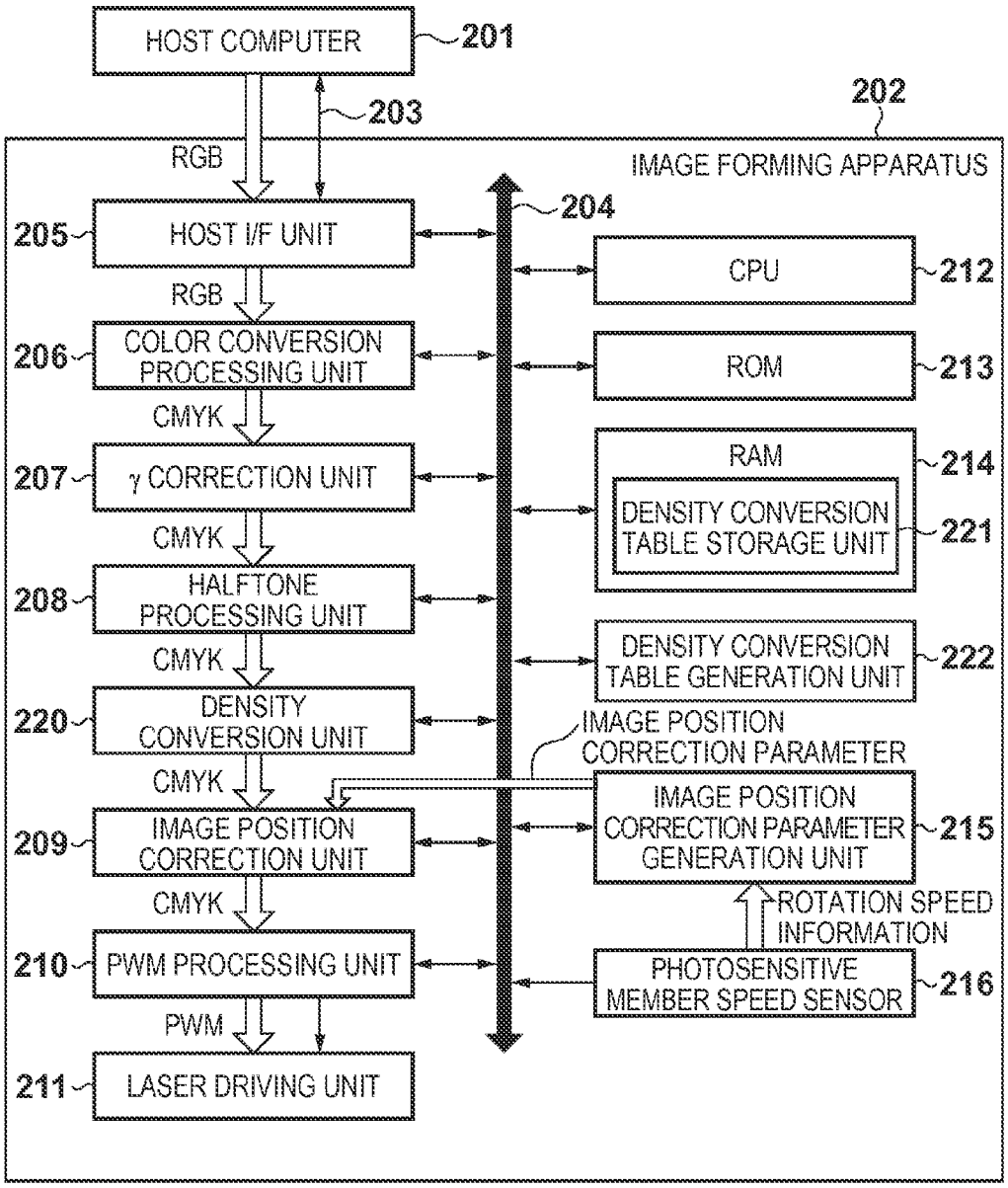
FIG. 11 is a block diagram showing another arrangement of image processing.

An example of the arrangement concerning image processing of an image forming apparatus according to this embodiment will be explained first with reference to FIG. 11. An image forming apparatus 202 includes a density conversion unit 220 in addition to the arrangement shown in FIG. 2 of the first embodiment. The apparatus further includes a density conversion table generation unit 222 configured to generate a density conversion table. An RAM 214 includes a density conversion table storage unit 221. The density conversion unit 220 performs density conversion processing to be described later for CMYK signals, which have undergone halftone processing, using the density conversion table generated by the density conversion table generation unit 222. Processing after the density conversion processing is the same as in the first embodiment, and a detailed description thereof will be omitted.

<Density Conversion Table Generation Processing>

Figure 12:
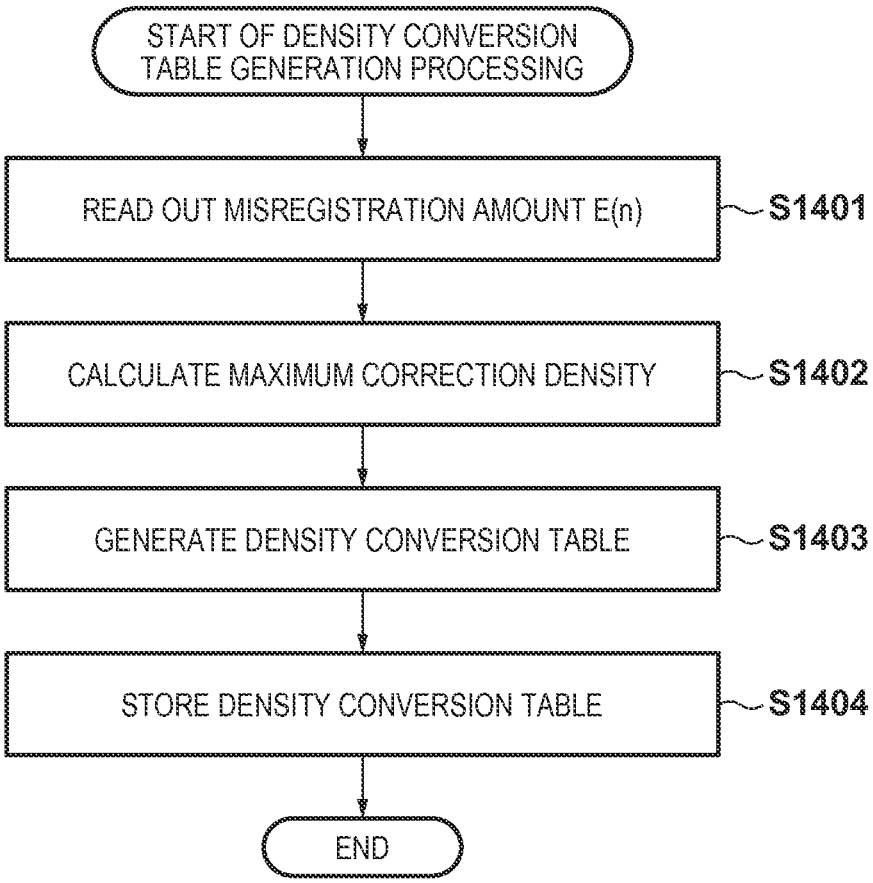
FIG. 12 is a flowchart illustrating the procedure of density conversion table generation processing.

A procedure of generating a density conversion table will be described next with reference to FIG. 12. In step S1401, the density conversion table generation unit 222 reads out an image misregistration amount from an image position correction parameter generation unit 215. The image position correction parameter generation unit 215 described in the first embodiment obtains the image misregistration amount in advance by calculating E(n) of equations (11), and a detailed description thereof will be omitted.

In step S1402, the density conversion table generation unit 222 performs image position correction processing for an image having a density of 100% using the readout image misregistration amount E(n), and obtains a maximum density Po_max in the image after the position correction. More specifically, the density conversion table generation unit 222 first performs calculation according to equations (12) described in the first embodiment. The highest one of the densities of the lines is defined as the maximum density Po_max. The maximum density Po_max is logically obtained without reading an actually formed toner image. Note that the image data with the density of 100% is directly input to an image position correction unit 209. For further improvement, a density change may be interpolated based on a uneven composite density period Tdm that is the least common multiple of a photosensitive drum rotation period Td and a motor rotation period Tm so as to more accurately obtain the maximum density Po_max. Note that the image position correction processing may be done by the image position correction unit 209, as in the first embodiment.

Figure 13:
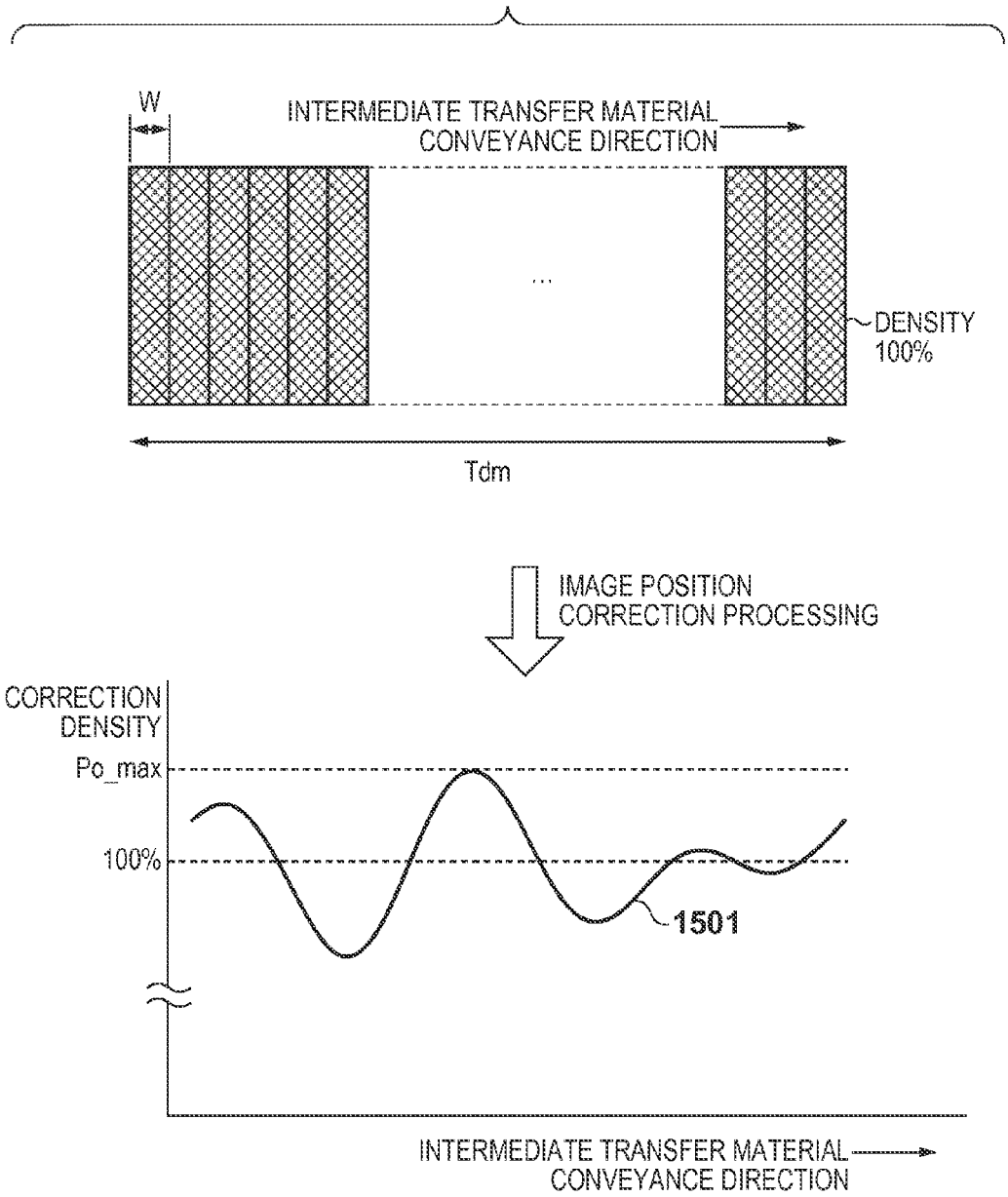
FIG. 13 is a view for explaining a method of obtaining a maximum correction density.

FIG. 13 shows a density change when image position correction is performed for an image having a density of 100%. Referring to FIG. 13, 1501 represents a logical density change of each scanning line after the image position correction has been performed for the image having the density of 100%. Note that the image position correction processing is performed by setting an exposure start time tp=0. In the description here, focus is placed on the density change when image position correction has been performed for the image having the density of 100%. However, if the density change (excess over 100%) as shown in FIG. 13 can almost be detected, the same effect can be obtained even when image position correction is performed for an image having a density of, for example, 98%. The density need not strictly be 100% if a density change ½ the difference between the maximum value and the minimum value of the varying density can almost be detected as an excess. That is, a density of about 100% suffices.

Figure 14:
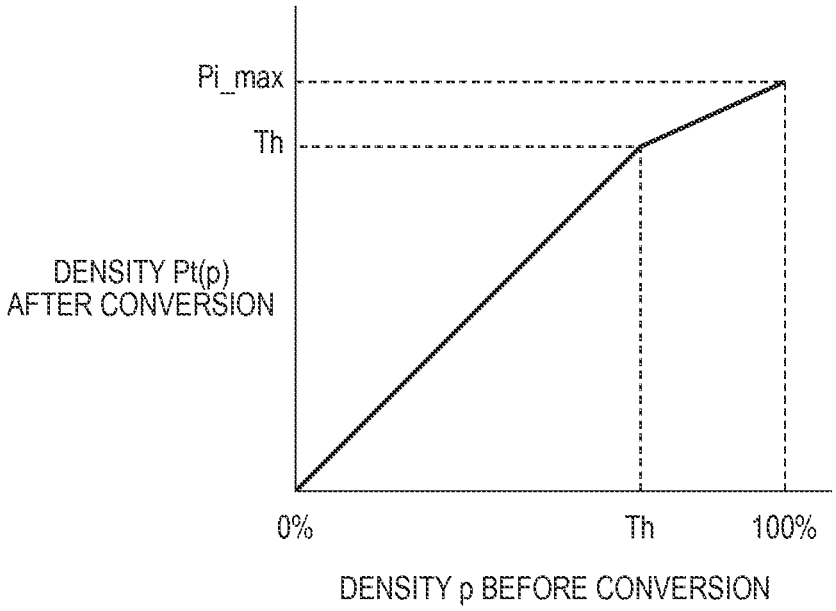
FIG. 14 is a graph of density tone value conversion.

In step S1403, the density conversion table generation unit 222 generates, using the maximum correction density Po_max, a density conversion table for converting the maximum correction density Po_max into Pi_max, as shown in FIG. 14. The graph of FIG. 14 represents the relationship between the tone value (density) of an image before density conversion and that after density conversion.

The maximum density Pi_max of the image input to the image position correction unit 209 is obtained from the maximum correction density Po_max by $$Pi_\max=(100\%/Po_\max)\times 100\% \tag{19}$$

Using Pi_max, a density conversion table Pt(p) can be represented by $$Pt(p)=p(p\leq Th)$$

$$Pt(p)=s\times p+Th\times(1-s)(p>Th)$$

$$s=(Pi_\max-Th)/(100\%-Th) \tag{20}$$

where Th is the threshold for density conversion, and Th<Pi_max. For example, Th=0.9×Pi_max. In addition, s is the slope of the line when p>Th.

In step S1404, the density conversion table generation unit 222 stores the generated density conversion table in the density conversion table storage unit 221 provided in the RAM 214. The processing of generating the density conversion table thus ends. From then on, the density conversion table generation unit 222 performs density change (density correction) using the stored density conversion table.

<Density Conversion Processing>

The density conversion processing will be described next. The density conversion unit 220 reads out the density conversion table stored in the density conversion table storage unit 221 and converts the density of a halftone-processed image in accordance with the density conversion table. With the density conversion processing, the pixel densities ranging from 0% (inclusive) to Th (inclusive) do not change, and the pixel densities ranging from Th (exclusive) to 100% (inclusive) are converted into densities Th to Pi_max. The calculation formula of Pi_max is equation (19) described above. In this way, only high-density pixels within a predetermined density range including the maximum density (100%) undergo the density conversion. The maximum density before image position correction is Pi_max. The density in a low density region does not exceed 100% even after image position correction processing. Hence, the density conversion is performed for only high-density pixels to suppress the decrease in the density of the entire image as much as possible. Note that the density conversion table need not always use the linear shape shown in FIG. 14, and a curve may also be used.

When the maximum density is lowered by the density conversion processing, as described above, the density does not exceed 100% after the image position correction for reducing uneven density caused by the mechanical factors of the members concerning image formation. For this reason, the uneven density can sufficiently be corrected. In FIG. 11, the density conversion unit 220 is arranged on the upstream side of the image position correction unit 209 to perform density conversion using the density conversion table for image data before image position correction, as described above. However, the present invention is not limited to this. The density over 100% may be suppressed below 100% by density conversion after image position correction by arranging the image position correction unit 209 on the upstream side of the density conversion unit 220 to perform density conversion using the density conversion table for image data after image position correction.

Third Embodiment

The third embodiment of the present invention will be described below with reference to FIGS. 15 to 19B. Note that the same reference numerals as in the first and second embodiments denote the same parts in the third embodiment, and a description thereof will be omitted. This embodiment features correcting uneven density without using position shift correction described in the above embodiments when uneven density mainly occurs due to the uneven rotation speed of a motor for driving a photosensitive drum. Note that in this embodiment, an example will be explained in which the density is lowered in advance in accordance with the uneven density correction amount before uneven density correction. In this embodiment, processing for the image of yellow Y will be described, as in the other embodiments. Actually, the same processing as that for yellow Y is performed for each color of CMYK.

<Arrangement of Image Forming Apparatus>

Figure 15:
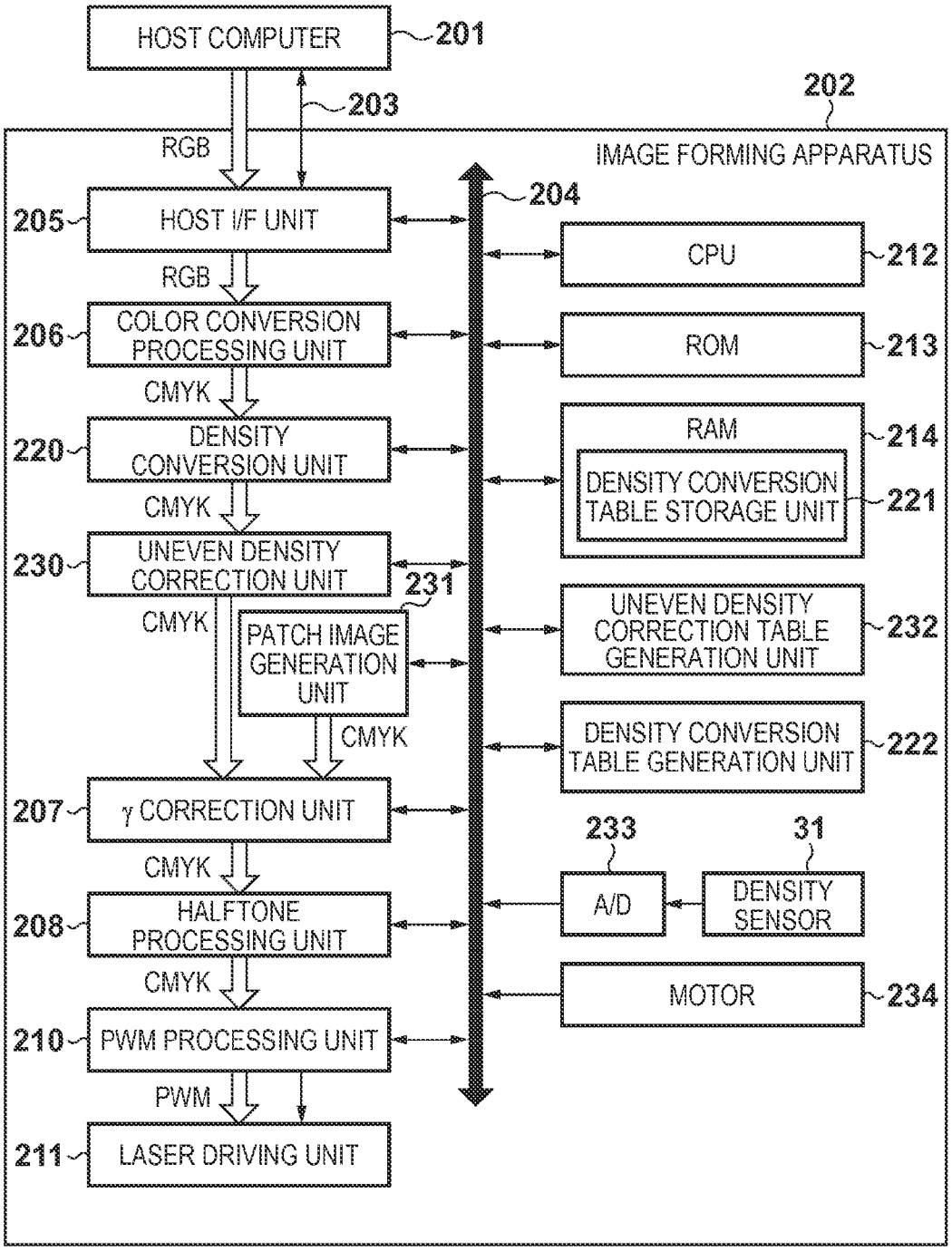
FIG. 15 is a block diagram showing still another arrangement of image processing.

An example of the arrangement concerning image processing of an image forming apparatus according to this embodiment will be explained first with reference to FIG. 15. The same reference numerals as in FIGS. 2 and 11 denote the same parts in FIG. 15, and a description thereof will be omitted. An image forming apparatus 202 further includes a patch image generation unit 231, an uneven density correction table generation unit 232, an A/D port 233, and a motor 234. The uneven density correction table generation unit 232 generates an uneven density correction table to be described later and outputs it to an uneven density correction unit 230. An analog signal from a density sensor 31 is converted into a digital signal by the A/D port 233 and stored in a RAM 214. The motor 234 drives a photosensitive drum 22Y and outputs a speed signal corresponding to the rotation speed of the motor. The remaining components have the same structures as in the above-described first and second embodiments, and a description thereof will be omitted.

The procedure of image processing of this embodiment will be described next. When a print operation starts, a host computer 201 outputs RGB image signals, as in the first and second embodiments, which are processed via a host I/F unit 205, a color conversion processing unit 206, a density conversion unit 220, and the uneven density correction unit 230. For the CMYK signals that have undergone the color conversion processing, the density conversion unit 220 performs density conversion processing using a density conversion table generated by a density conversion table generation unit 222. After the density conversion processing, the uneven density correction unit 230 performs uneven density correction processing to be described later using an uneven density correction table. After that, the CMYK signals that have undergone the uneven density correction processing are processed via a γ correction unit 207, a halftone processing unit 208, a PWM processing unit 210, and a laser driving unit 211.

The patch image generation unit 231 outputs, to the γ correction unit 207, a signal of a patch image to be used to detect uneven density in uneven density detection processing to be described later. The patch image data passes through the halftone processing unit 208 and the PWM processing unit 210 and is output to the laser driving unit 211 as PWM data. The image forming apparatus of this embodiment performs uneven density detection processing when powered on or when a predetermined number of sheets are printed.

<Uneven density Detection Processing>

Figure 16:
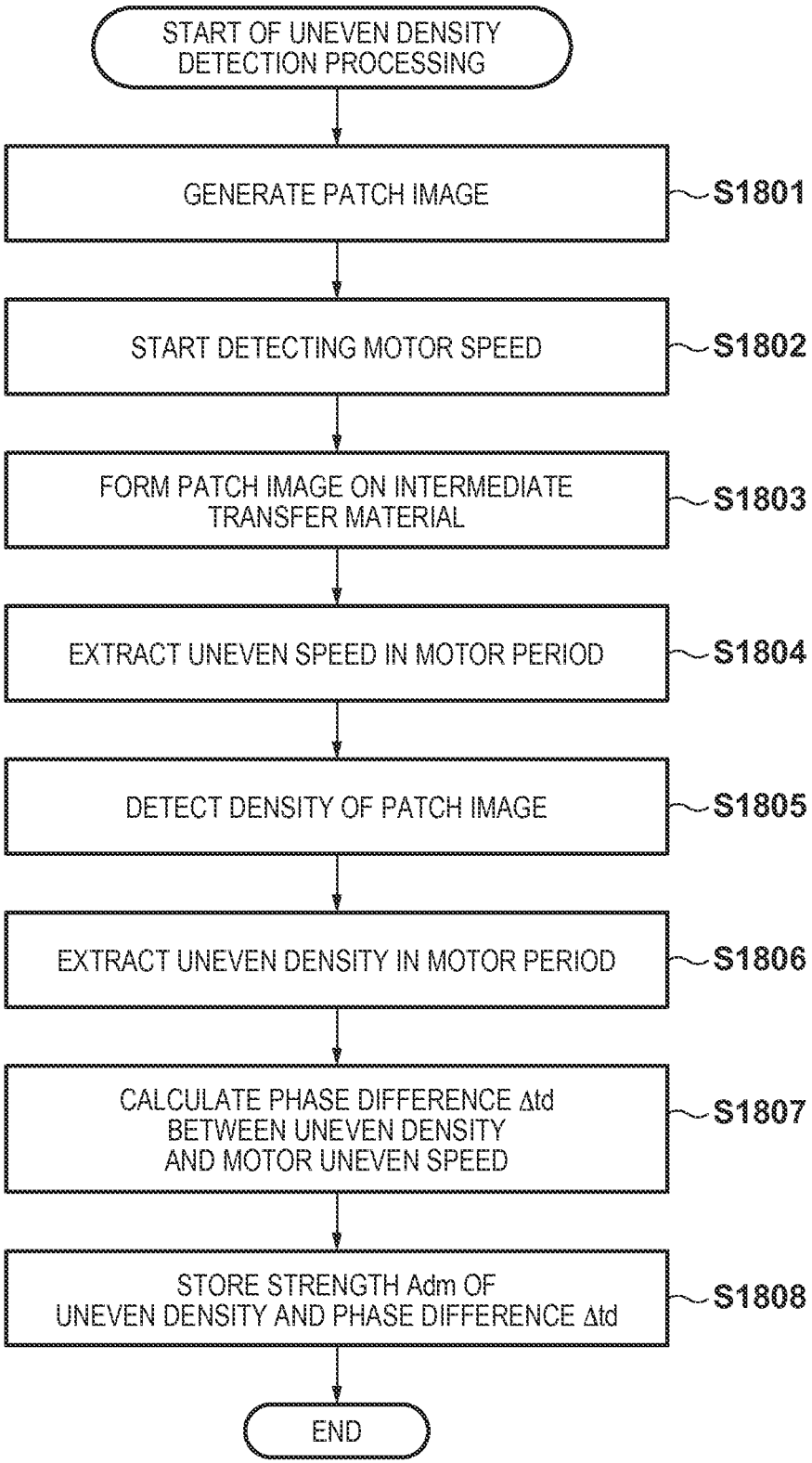
FIG. 16 is a flowchart illustrating the procedure of uneven density detection processing.
Figure 17:
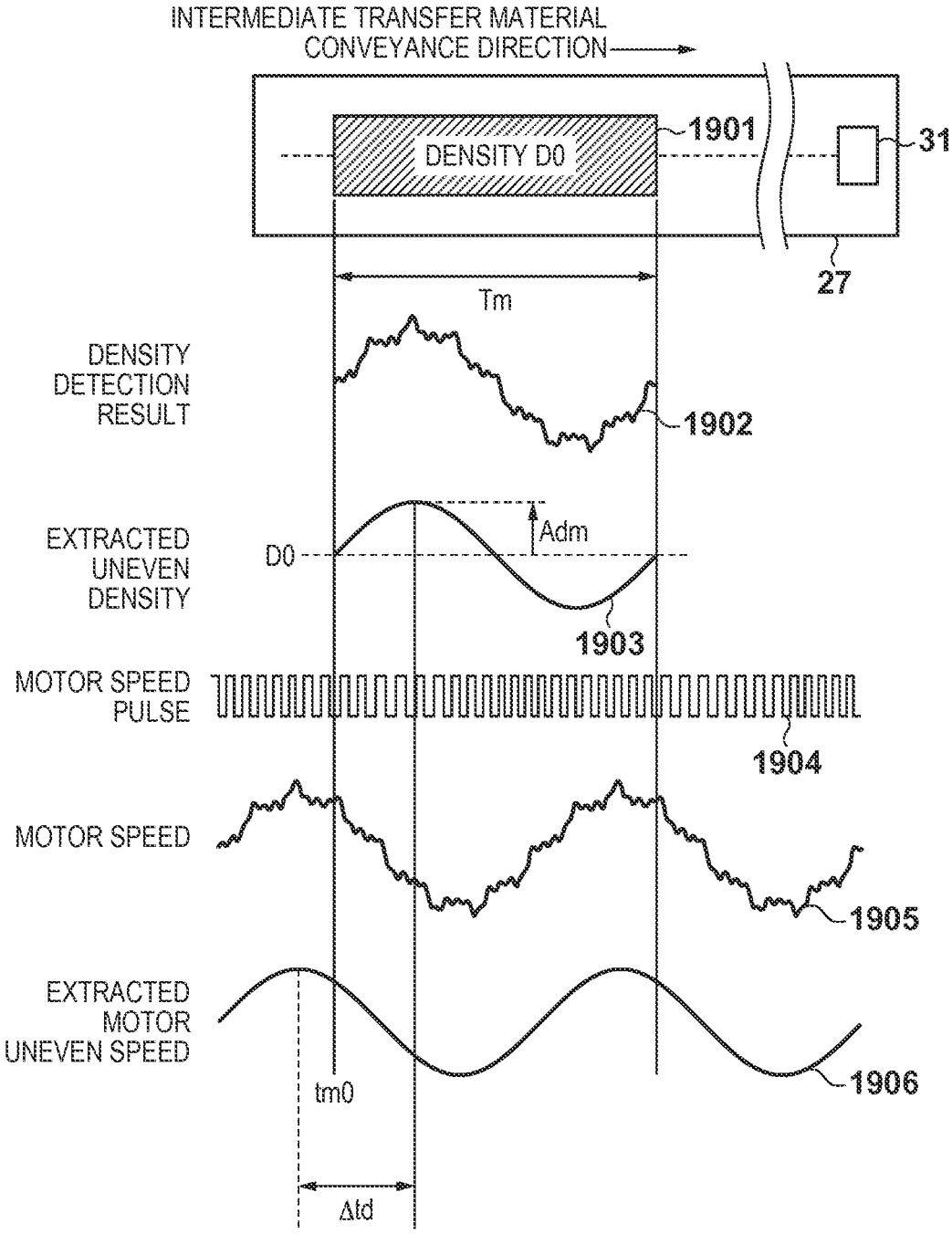
FIG. 17 is an explanatory view of uneven density detection processing.

The uneven density detection processing will be described next with reference to FIGS. 16 and 17. FIG. 16 illustrates the procedure of uneven density detection processing. FIG. 17 shows the uneven density detection processing.

When the uneven density detection processing starts, in step S1801, the patch image generation unit 231 outputs a patch image signal to generate a patch image 1901 shown in FIG. 17, which is to be used to detect uneven density. The patch image 1901 is a halftone-processed image having a density D0. D0 is the most easily detectable density. The length of the patch image 1901 in the conveyance direction of an intermediate transfer belt 27 is equal to or longer than the motor rotation period.

In step S1802, a CPU 212 starts detecting the speed of the motor 234 via the A/D port 233.

Reference numeral 1904 in FIG. 17 denotes an example of an FG signal generated by the motor 234. The CPU 212 obtains the rotation speed of the motor based on the output FG signal. The method of obtaining the rotation speed from the FG signal is the same as the method of detecting the surface speed of the photosensitive drum 22Y from the pulse signal of a rotary encoder in the first embodiment. Reference numeral 1905 in FIG. 17 denotes an example of the rotation speed of the motor calculated from the FG signal.

In step S1803, the laser driving unit 211 operates based on the patch image signal generated in step S1801. When the laser driving unit 211 operates, the photosensitive drums 22Y, 22M, 22C, and 22K are selectively exposed to form electrostatic latent images so that a patch image is formed on the intermediate transfer belt 27 (on the rotation member). The exposure start time of the patch image 1901 at this time is tm0. Simultaneously, the speed of the motor 234 is detected until image formation of the patch image 1901 is completed. The processing of steps S1801 to S1803 is an example of processing of a patch forming unit.

In step S1804, the CPU 212 extracts an uneven speed Vm(t) in a motor rotation period Tm from the detected rotation speed of the motor 234. To extract Vm(t), a strength Avm and a phase ϕvm of the uneven speed Vm(t) are calculated by Fourier transformation. The extracted uneven speed Vm(t) is given by $$Vm(t)=Avm\times\sin(\omega m\times t+\phi vm)$$

$$\omega m=2\pi/Tm \tag{21}$$

Reference numeral 1906 denotes an example of the extracted uneven speed in the motor rotation period.

The patch image 1901 formed on the intermediate transfer belt 27 is conveyed immediately under the density sensor 31. In step S1805, the density sensor 31 detects the density of the patch image 1901 along the conveyance direction of the intermediate transfer belt 27. Reference numeral 1902 denotes an example of the detected density. After that, in step S1806, the CPU 212 extracts, from the detected density, uneven density in the motor rotation period Tm by Fourier transformation. To extract the uneven density, a strength Adm and a phase ϕdm are calculated by Fourier transformation. An extracted uneven density Ddm(y) is given by $$Ddm(y)=Ddmt(tm0+y/Vmo)$$

$$Ddmt(t)=Adm\times\sin(\omega m\times t+\phi dm)$$

$$\omega m=2\pi/Tm \tag{22}$$

Ddm(y) of equations (22) represents that the uneven density at a position y in the conveyance direction equals the uneven density represented by Ddmt(t) of t=(tm0+y/Vmo), where y is the position in the conveyance direction of the intermediate transfer belt 27, tm0 is the exposure start time of the patch image 1901, and Vmo is the average rotation speed of the motor. Reference numeral 1903 denotes an example of the extracted uneven density.

In step S1807, the CPU 212 obtains a phase difference Δtd between the extracted uneven density and the uneven speed of the motor 234 by $$\Delta td=\phi dm-\phi vm \tag{23}$$

In step S1808, the CPU 212 stores the obtained strength Adm of the uneven density and the phase difference Δtd in the RAM 214. The uneven density detection processing thus ends.

<Uneven Density Correction Processing>

The uneven density correction processing of the uneven density correction unit 230 will be described next with reference to FIG. 18. In step S2101, when the uneven density correction processing starts, the uneven density correction unit 230 decides an exposure start time tp. The exposure start time tp is the time each unit in the image forming apparatus has transited to an image formation enable state to enable image exposure.

Next, in step S2102, the uneven density correction unit 230 detects the rotation speed of the motor 234 by the above-described method. In step S2103, the uneven density correction unit 230 extracts an uneven speed Vm'(t) in the motor rotation period Tm from the detected rotation speed of the motor 234 and obtains the phase of Vm'(t). Vm'(t) is given by $$Vm'(t)=Avm'\times\sin(\omega m\times t+\phi vm')$$

$$\omega m=2\pi/Tm \tag{24}$$

In step S2104, the uneven density correction unit 230 reads out the amplitude Adm and the phase difference Δtd from the RAM 214. In step S2105, the uneven density correction unit 230 predicts (calculates) an uneven density Ddm'(y) corresponding to the density D0 from the readout amplitude Adm and phase difference Δtd. Note that not one tone but a plurality of tones of 10%, 20%, . . . , 90% may be used to perform accurate prediction from the highlight to the shadow range.

Since the phase difference between the uneven density and the uneven speed in the motor rotation period Tm is Δtd, the uneven density Ddm'(y) is given by $$Ddm'(y)=Ddmt'(tp+y/Vmo)$$

$$Ddmt'(t)=Adm\times\sin(\omega m\times t+\phi vm'+\Delta td) \tag{25}$$

Ddm'(y) of equations (25) represents that the uneven density at the position y in the conveyance direction equals the uneven density represented by Ddmt'(t) of t=(tp+y/Vmo).

In step S2106, the uneven density correction unit 230 initializes a counter n that counts a line under processing to 0. In step S2107, the uneven density correction table generation unit 232 generates an uneven density correction table for each line based on the uneven density Ddm'(y).

A method of generating the uneven density correction table for the nth line will be described with reference to FIGS. 19A and 19B. FIG. 19A shows the uneven density characteristic of the nth line. The uneven density characteristic represents how the density changes due to the uneven density. The uneven density of the nth line is assumed to be uneven density at the intermediate position (y=W×n+W/2) of the line in the conveyance direction. A density change amount ΔD(n) of the density D0 is given by $$\Delta D0(n)=Ddm'(W\times n+W/2) \tag{26}$$

where W is the target line interval.

In FIG. 19A, 2201 represents an uneven density characteristic when the density D0 changes to density D0+ΔD(n) due to uneven density. As indicated by 2201, when the density D0 changes to density D0+ΔD(n) due to uneven density, it can be predicted that a density Di1 be a density Ds1, and a density Di_max be a density of 100%. The uneven density correction table generation unit 232 generates an uneven density correction table having a reverse characteristic based on the uneven density characteristic.

Figure 19B:
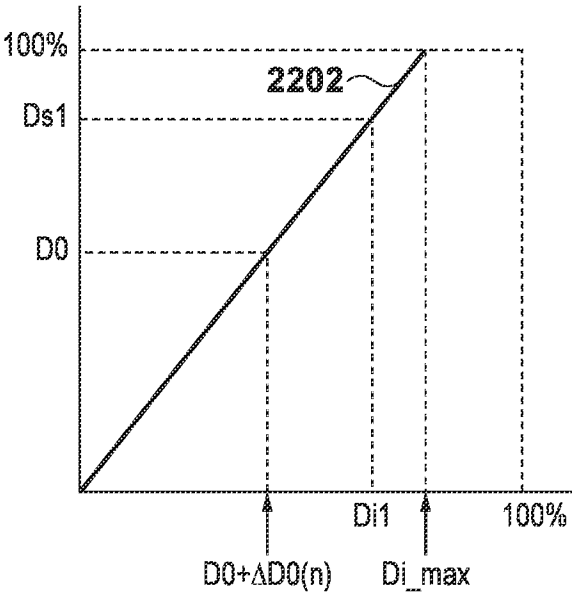
FIGS. 19A and 19B are graphs of a density conversion table.
Figure 19A:
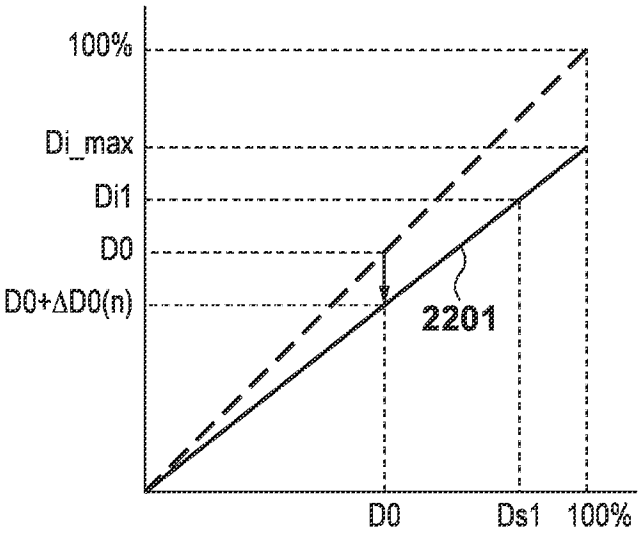
Figure 20:
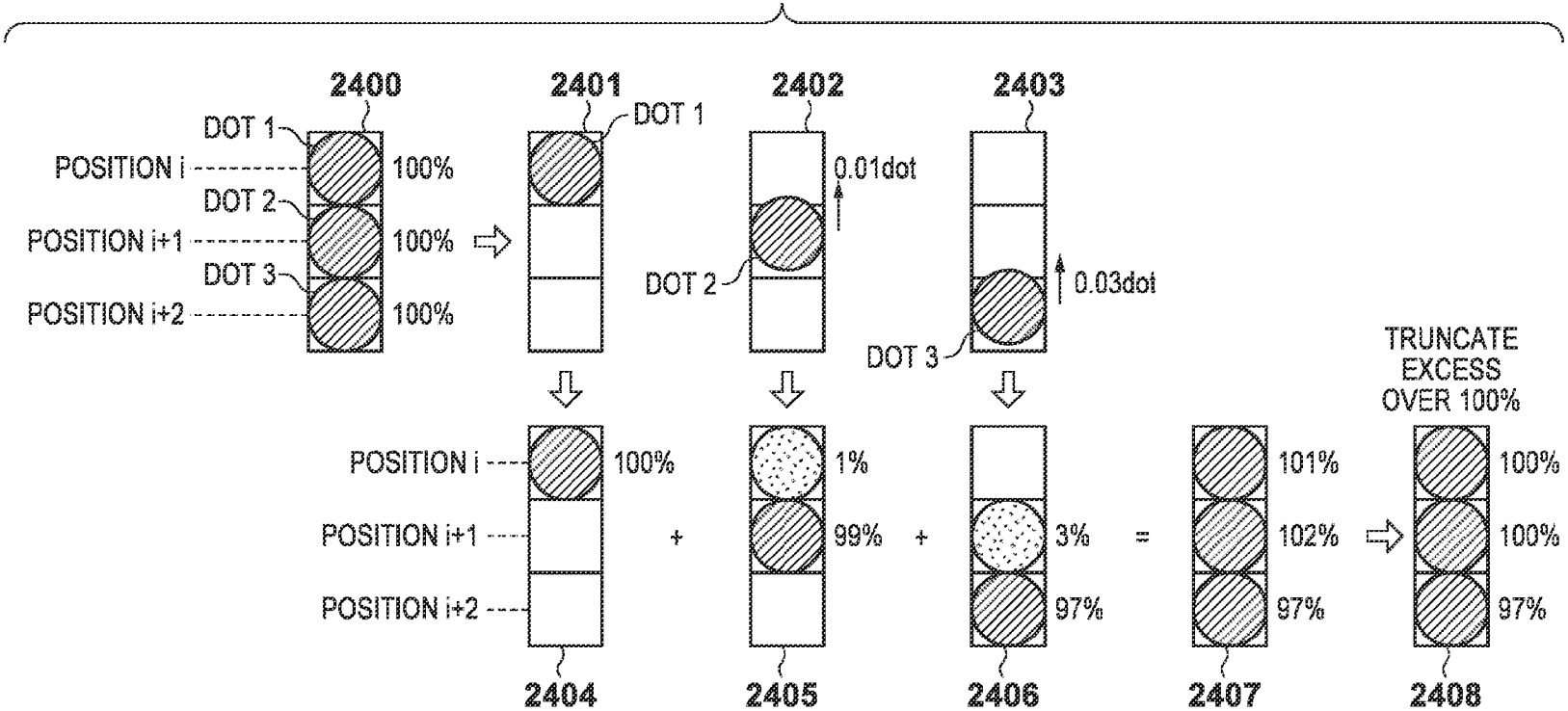
FIG. 20 is a view showing image position correction when the density exceeds 100%.

FIG. 19B shows the uneven density correction table of the nth line. If the uneven density characteristic represents that the density Ds1 corresponds to the density Di1, as indicated by 2201 in FIG. 19A, the uneven density correction table is designed to convert the density Di1 into the density Ds1. In FIG. 19B, 2202 represents an uneven density correction table generated based on the uneven density characteristic 2201.

Note that the uneven density correction table is generated based on ΔD(n), as described above, and identical uneven density correction tables repetitively appear for the lines at the change period of ΔD(n). Hence, instead of generating the uneven density correction tables of all lines, only uneven density correction tables for one period are generated, held in the RAM 214 or the like, and repetitively looked up.

Referring back to FIG. 18, in step S2108, the uneven density correction unit 230 converts the density of each pixel of the nth line based on the generated uneven density correction table. Since the uneven density correction table has a characteristic reverse to the uneven density characteristic, uneven density can be canceled by conversion using the uneven density correction table. After that, in step S2109, the uneven density correction unit 230 determines whether the processing has ended up to a predetermined line (the final line of the image input to the uneven density correction unit 230). If the processing has not ended, the process advances to step S2110 to increment the counter n, and the processing is repeated from step S2107. If the processing has ended, the uneven density correction processing ends.

Note that generating the uneven density correction table in real time in the image forming apparatus in step S2107 has been described with reference to the flowchart of FIG. 18. However, the uneven density correction table may be generated in advance in the factory where the image forming apparatus is manufactured. In this case, a mark is put on the rotation portion of the motor, and uneven density correction tables measured based on the mark in the factory are stored in a ROM 213. The image forming apparatus sequentially reads out, from the ROM 213, an uneven density correction table stored in advance in correspondence with each line based on the mark detection timing upon printing.

<Processing for Excess Density>

Figure 18:
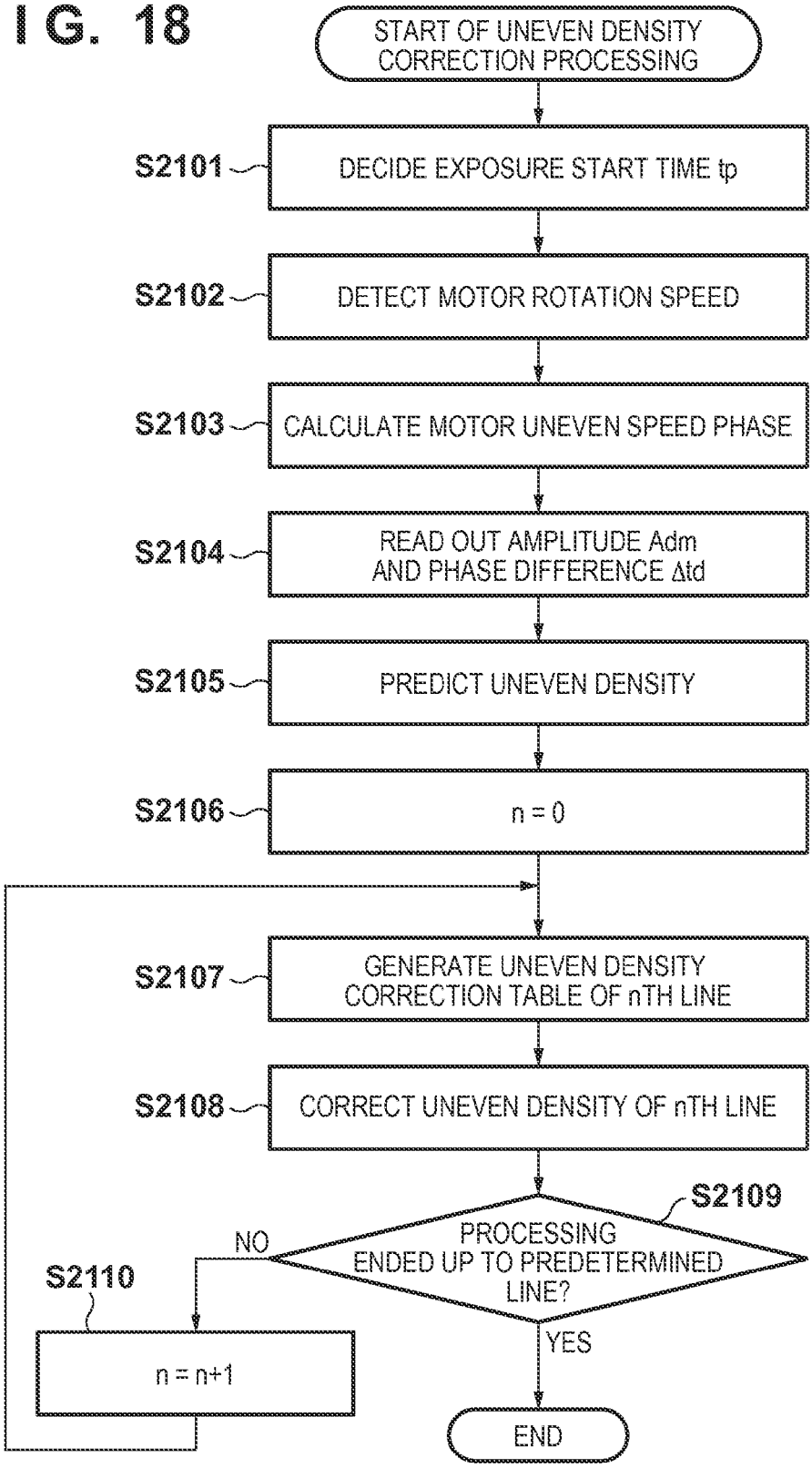
FIG. 18 is a flowchart illustrating the procedure of uneven density correction processing.

Image data that has undergone the density correction processing is generated by executing the above-described flowcharts of FIGS. 16 and 18. The overflow processing described in step S806 of the first embodiment is executed for the image data that has undergone the density correction processing. Alternatively, for the density of the image data after the density correction, a maximum density Po_max is obtained in accordance with the same procedure as in the second embodiment, and the density conversion table generation unit 222 generates a density conversion table (FIG. 14). The overflow processing and processing after generation of the density conversion table (FIG. 14) are the same as in the first and second embodiments.

As described above, in the third embodiment, density correction is performed for uneven density (banding) using a correction table generated by the uneven density correction table generation unit 232 in place of performing image position correction as described by equations (12) of the first or second embodiment. Even in thus corrected image data, the measures against uneven density described in the first and second embodiment can be done for a pixel whose density exceeds the upper limit (100%) of the output density. Note that when using the density conversion table (FIG. 14) described in the second embodiment as a measure against the maximum density, the density over 100% may be suppressed below 100% by density conversion after uneven density correction according to the flowchart of FIG. 18.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-019144, filed Jan. 31, 2011, which is hereby incorporated by reference herein in its entirety.

What is claimed is:

1. An image forming apparatus comprising:

a rotation member on which an image is formed; and a correction unit configured to correct, for uneven density caused by uneven rotation of a rotation speed of said rotation member, image data to reduce the uneven density, wherein said correction unit is configured to diffuse, for a pixel of interest whose density exceeds an upper limit of an output density out of pixels of the corrected image data, an excess of the density more than the upper limit to a plurality of peripheral pixels while maintaining a center of gravity of the density.

2. The apparatus according to claim 1, wherein said correction unit is configured to, when the excess of the density is uniformly diffused to the plurality of peripheral pixels, determine whether any one of densities of the plurality of peripheral pixels exceeds the upper limit of the output density, and upon determining that any one of the densities of the plurality of peripheral pixels exceeds the upper limit of the output density, said correction unit decreases a diffusion amount such that none of the densities of the plurality of peripheral pixels exceeds the upper limit of the output density.

3. The apparatus according to claim 1, wherein after said correction unit has decreased a diffusion amount and executed the diffusion, the excess of the density of the pixel of interest, which remains without being diffused, is diffused to other peripheral pixels apart from the pixel of interest by a longer distance than that in preceding diffusion.

4. The apparatus according to claim 1, wherein said correction unit is configured to, after executing the diffusion, truncate the excess of the density of the pixel of interest, which remains without being diffused.

5. The apparatus according to claim 1, wherein said correction unit is configured to predict a misregistration amount of each scanning line in a sub-scanning direction upon image formation, which is generated by uneven rotation speed of said rotation member and corresponds to the uneven rotation speed, and to perform correction based on the predicted misregistration amount of each scanning line so as to shift image data of each scanning line in a direction in which the misregistration amount is reduced.

6. The apparatus according to claim 5, wherein said rotation member includes an image carrier, the apparatus further comprises:

an exposure unit configured to expose said image carrier to form an electrostatic latent image on a surface of said image carrier;

a developing unit configured to develop the electrostatic latent image formed on said image carrier using a toner; and a transfer unit configured to transfer, to an intermediate transfer material, the electrostatic latent image developed on the surface of said image carrier, and said correction unit predicts the misregistration amount of each scanning line in an image formed on the intermediate transfer material.

7. The apparatus according to claim 1, wherein said correction unit is configured to predict a density change amount of each scanning line upon image formation, which is generated by uneven rotation speed of said rotation member and corresponds to the uneven rotation speed, and to correct a tone value of the image data based on the predicted density change amount of each scanning line so as to reduce the density change amount of each scanning line.

8. The apparatus according to claim 7, further comprising:

a patch forming unit configured to form, on said rotation member, a patch image to be used to predict the density change amount caused by the uneven rotation speed; and a detection unit configured to detect a density of the formed patch image, wherein said correction unit is configured to calculate, from the detected density, a density change amount corresponding to a phase of the uneven speed.

9. An image forming apparatus comprising:

a rotation member on which an image is formed; and a correction unit configured to correct, for uneven density caused by uneven rotation of a rotation speed of said rotation member, image data to reduce the uneven density, wherein said correction unit is configured to convert a tone value of a density of each pixel of the image data before or after the correction such that the density does not exceed an upper limit of an output density by the correction of the image data to reduce the uneven density.

10. The apparatus according to claim 9, wherein:

said correction unit calculates a maximum density of the image data after executing the correction, and generates density conversion information indicating a relationship between a density before a density conversion and a density after density conversion according to the calculated maximum density, and converts a density of each pixel of the image data using the density conversion information.

11. The apparatus according to claim 9, wherein said correction unit targets, as a processing target of the density conversion, only a high-density pixel within a predetermined density range from a density of the upper limit of the output density.

12. The apparatus according to claim 9, wherein said correction unit is configured to predict a misregistration amount of each scanning line in a sub-scanning direction upon image formation, which is generated by uneven rotation speed of said rotation member and corresponds to the uneven rotation speed, and to perform correction based on the predicted misregistration amount of each scanning line so as to shift image data of each scanning line in a direction in which the misregistration amount is reduced.

13. The apparatus according to claim 9, wherein said rotation member includes an image carrier, the apparatus further comprises:

an exposure unit configured to expose said image carrier to form an electrostatic latent image on a surface of said image carrier;

a developing unit configured to develop the electrostatic latent image formed on said image carrier using a toner; and a transfer unit configured to transfer, to an intermediate transfer material, the electrostatic latent image developed on the surface of said image carrier, and said correction unit predicts the misregistration amount of each scanning line in an image formed on the intermediate transfer material.

14. The apparatus according to claim 9, wherein said correction unit is configured to predict a density change amount of each scanning line upon image formation, which is generated by uneven rotation speed of said rotation member and corresponds to the uneven rotation speed, and to correct a tone value of the image data based on the predicted density change amount of each scanning line so as to reduce the density change amount of each scanning line.

15. The apparatus according to claim 14, further comprising:

a patch forming unit configured to form, on said rotation member, a patch image to be used to predict the density change amount caused by the uneven rotation speed; and a detection unit configured to detect a density of the formed patch image, wherein said correction unit is configured to calculate, from the detected density, a density change amount corresponding to a phase of the uneven speed.

* * * * *